US006596680B2

(12) United States Patent
Kott et al.

(10) Patent No.: US 6,596,680 B2
(45) Date of Patent: Jul. 22, 2003

(54) ENHANCED ALKYLBENZENE SURFACTANT MIXTURE

(75) Inventors: Kevin Lee Kott, Loveland, OH (US); Jeffrey John Scheibel, Loveland, OH (US); Roland George Severson, Cincinnati, OH (US); Thomas Anthony Cripe, Loveland, OH (US); James Charles Theophile Roger Burckett-St. Laurent, Lasne (BE); Thomas Walter Federle, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/859,113

(22) Filed: May 16, 2001

(65) Prior Publication Data

US 2002/0082182 A1 Jun. 27, 2002

Related U.S. Application Data

(63) Continuation-in-part of application No. 09/478,908, filed on Jan. 7, 2000, which is a continuation of application No. PCT/IB98/01101, filed on Jul. 20, 1998.

(60) Provisional application No. 60/053,318, filed on Jul. 21, 1997.

(51) Int. Cl.[7] ..... C11D 17/00

(52) U.S. Cl. ..... 510/426; 510/276; 510/428; 510/357; 510/492; 510/536

(58) Field of Search ..... 510/276, 357, 510/426, 428, 492, 536

(56) References Cited

U.S. PATENT DOCUMENTS

| | | | | |
|---|---|---|---|---|
| 3,351,654 A | * | 11/1967 | Gudelis | 252/550 |
| 3,427,342 A | | 2/1969 | Brooks et al. | |
| 4,861,935 A | | 8/1989 | Bakas et al. | |
| 4,870,038 A | * | 9/1989 | Page et al. | 091989/502 |
| 4,990,718 A | * | 2/1991 | Pelrine | 585/455 |
| 5,026,933 A | * | 6/1991 | Blain et al. | 585/7 |
| 5,057,472 A | | 10/1991 | Hertzengerg et al. | |
| 5,175,135 A | | 12/1992 | Lee et al. | |
| 5,198,595 A | | 3/1993 | Lee et al. | |
| 5,243,116 A | | 9/1993 | Lee et al. | |
| 5,777,187 A | | 7/1998 | Knifton et al. | |

FOREIGN PATENT DOCUMENTS

| | | |
|---|---|---|
| EP | 466558 | 3/1991 |
| WO | WO 99 05242 | 2/1999 |
| WO | WO 00 23548 | 4/2000 |
| WO | WO 00 23549 | 4/2000 |
| WO | WO 00 43473 | 7/2000 |

OTHER PUBLICATIONS

Thomas M. Schmitt, "Analysis of Surfactants", Surfactant Science Series, 1992, vol. 40 pp. 230–231, Marcel Dekker, Inc., New York.

Marshall Sittig, "Detergent Manufacture Including Zeolite Builders and Other New Materials", 1979, pp. 206–252, Noyes Data Corp., New Jersey.

W.H. De Groot, "Sulfonation Technology in the Detergent Industry", 1991, pp. 83–111, Kluwer Academic Publishers, Dordrecht, Netherlands.

G.F. Longman, "The Analysis of Detergents and Detergent Products", pp. 197–199.

* cited by examiner

*Primary Examiner*—Necholus Ogden
(74) *Attorney, Agent, or Firm*—Richard S. Echler, Sr.; Kim W. Zerby; Steven W. Miller

(57) ABSTRACT

Surfactant mixtures, improved detergent and cleaning products containing particular types of alkybenzene sulfonate surfactants.

24 Claims, No Drawings

ENHANCED ALKYLBENZENE SURFACTANT MIXTURE

RELATED APPLICATIONS

This application is a CIP application Ser. No. 09/478,908, which was filed on Jan. 7, 2000, pending which is a con of PCT International Application No. PCT/IB98/01101, which was filed on Jul. 20, 1998, which claims benefit of U.S. Provisional Application Ser. No. 60/053,318, which was filed on Jul. 21, 1997.

FIELD OF THE INVENTION

The present invention relates to particular types of alkylbenzene sulfonate surfactant mixtures adapted for laundry and cleaning product use by controlling compositional parameters, especially a 2/3-phenyl index, a 2-methyl-2-phenyl index and linearity, as well as to improved detergent and cleaning products containing these surfactant mixtures, to alkylbenzene precursors for the surfactant mixtures, and to methods of making the precursors as well as the surfactant mixtures. The present compositions are especially useful for fabric laundering.

BACKGROUND OF THE INVENTION

Historically, highly branched alkylbenzene sulfonate surfactants, such as those based on tetrapropylene, known as "ABS" or "TPBS", were used in detergents. However, these were found to be very poorly biodegradable. A long period followed of improving manufacturing processes for alkylbenzene sulfonates, making them as linear as practically possible, hence the acronym "LAS". The overwhelming part of a large art of linear alkylbenzene sulfonate surfactant manufacture is directed to this objective. However, linear alkylbenzene sulfonates are not without limitations; for example, they would be more desirable if improved for hard water cleaning and/or cold water cleaning properties. They can often fail to produce good cleaning results, for example when formulated with nonphosphate builders and/or when used in hard water areas.

As a result of the limitations of the alkylbenzene sulfonates, consumer cleaning formulations have often needed to include a higher level of co-surfactants, builders, and other additives than would have been needed given a superior alkylbenzene sulfonate. Yet another currently unresolved problem in alkylbenzene sulfonate manufacture is to make more effective use of current LAB feedstock. It would be highly desirable, both from a performance point of view and from an economic point of view, to better utilize certain desirable types of branched hydrocarbons.

Accordingly there exists a substantial unment need for further improvements in alkylbenzene sulfonate surfactant mixtures. Improved alkylbenzene sulfonates should provide one or more of the following advantages: superior cleaning, hardness tolerance, biodegradability and cost.

SUMMARY OF THE INVENTION

It has now surprisingly been found that there exist certain alkylbenzene sulfonate surfactant mixtures, hereinafter "enhanced alkylbenzene sulfonate surfactant mixtures" which offer one or more, and even several of the above-outlined advantages. The discovery of these mixtures solves important problems of the kind described in the background.

More specifically, it has now surprisingly been found for that the alkylbenzene sulfonate surfactant mixtures of the present invention provide superior cleaning performance, cost advantage, along with good biodegradability as compared to conventional alkylbenzene sulfonate surfactant mixtures. In most cases, standard environmental tests, such as the previously described Modified SCAS, are sufficient in determining acceptable surfactant biodegradability. It has additionally been discovered that the alkylbenzene sulfonate surfactant mixtures of the present invention afford a further improved performance and biodegradation profile over the prior art. The present invention achieves the further improved profile by optimizing key compositional parameters, including, but not limited to, the 2/3-phenyl index, the 2-methyl-2-phenyl index and overall linearity. These features provide superior cleaning performance to those who practice the invention, while providing globally acceptable protection of the environment during and following such practice.

In a first aspect of the present invention, an enhanced alkylbenzene sulfonate surfactant mixture comprising:

(a) from about 60% to about 25% by weight of a mixture of enhanced alkylbenzene sulfonates having formula (I):

(I)

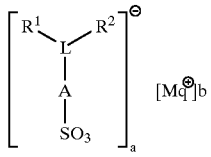

wherein L is an acyclic aliphatic moiety consisting of carbon and hydrogen, said L having two methyl termini and said L having no substituents other than A, $R^1$ and $R^2$; and wherein said mixture of enhanced alkylbenzene sulfonates contains two or more of said enhanced alkylbenzene sulfonates differing in molecular weight of the anion of said formula (I) and wherein said mixture of enhanced alkylbenzene sulfonates has a sum of carbon atoms in $R^1$, L and $R^2$ of from 9 to 15 an average aliphatic carbon content of from about 10.0 to about 14.0 carbon atoms; M is a cation or cation mixture, M having a valence q of the value of from 1 to 2; a and b are integers selected such that said enhanced alkylbenzene sulfonates are electroneutral; $R^1$ is $C_1$–$C_3$ alkyl; $R^2$ is selected from H and $C_1$–$C_3$ alkyl provided that in at least about 0.5 to 1.0 mole fraction of said enhanced alkylbenzene sulfonates, $R^2$ is H; A is a benzene moiety or any other aromatic that would exhibit the same characteristics as the aforementioned benzene moiety under the above-described conditions; and (b) from about 40% to about 75% by weight of a mixture of modified unsubstituted alkylbenzene sulfonates having formula (II):

(II)

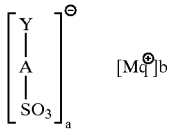

wherein a, b, M, A and q are as defined hereinbefore and Y is a linear unsubstituted aliphatic moiety having no substitution other than A, consisting of carbon and hydrogen having two methyl termini, and wherein said Y has a sum of carbon atoms of from 9 to 15 and said Y has an average aliphatic carbon content of from about 10.0 to about 14.0; and wherein said modified unsubstituted alkylbenzene sulfonate surfactant mixture is further characterized by a 2/3-phenyl index of from about 275 to about 10,000, is provided.

In a second aspect of the present invention, a process for making an alkylbenzene sulfonate surfactant mixture comprising the steps of: (I) alkylating benzene with an alkylating mixture; (II) sulfonating the product of (I); and (optionally, but preferably) (III) neutralizing the product of (II); wherein said alkylating mixture comprises: (a) 1% to about 99%, by weight of methyl substituted $C_9$–$C_{15}$ monoolefins, said methyl substituted monoolefins having structures identical with those of the methyl substituted monoolefins formed by dehydrogenating methyl substituted paraffins of formula $R^1LR^2$ wherein L is an acyclic aliphatic moiety consisting of carbon and hydrogen and containing two terminal methyls; $R^1$ is $C_1$ to $C_3$ alkyl; and $R^2$ is selected from H and $C_1$ to $C_3$ alkyl; and (b) from about 0.1% to about 85%, by weight of $C_9$–$Cl_5$ linear aliphatic olefins; wherein said alkylating mixture contains said methyl substituted $C_9$–$C_{20}$ monoolefins having at least two different carbon numbers in said $C_9$–$C_{20}$ range, and has a mean carbon content of from about 9.0 to about 15.0 carbon atoms; and wherein said components (a) and (b) are at a weight ratio of at least about 15:85, is provided.

In another aspect of the present invention, an alkylbenzene sulfonate surfactant mixture made by the process described above is provided.

In still another aspect of the present invention, detergent compositions, especially laundry detergent compositions, comprising the enhanced alkylbenzene sulfonate surfactant mixture of the present invention are provided. Such detergent compositions generally contain an amount of the enhanced alkylbenzene sulfonate surfactant mixture useful in cleaning fabrics, and amounts of laundry detergent-specific adjuncts which distinguish the preferred compositions herein from compositions used in non-laundry detergent fields.

The invention, on the other hand, is not intended to encompass any wholly conventional alkylbenzene sulfonate compositions or the derivative detergent compositions, such as those based exclusively on linear alkylbenzene sulfonates made by any process, or exclusively on known unacceptably branched alkylbenzene sulfonates such as ABS or TPBS.

In yet another aspect of the present invention, an enhanced alkylbenzene mixture is provided. This alkylbenzene mixture is useful for making the enhanced alkylbenzene sulfonate surfactant mixtures of the first and second embodiments, and comprises: (a) from about 60% to about 25% by weight of a mixture of enhanced alkylbenzenes having formula (I):

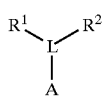

(I)

wherein L is an acyclic aliphatic moiety consisting of carbon and hydrogen and having two methyl termini, and wherein said mixture of enhanced alkylbenzenes contains two or more compounds of said formula (I) differing in molecular weight and wherein said mixture of enhanced alkylbenzenes is characterized by a sum of carbon atoms in $R^1$, $R^2$ and L of from 9 to 15; and an average aliphatic carbon content (i.e., excluding A), based on the sum of $R^1$, L and $R^2$, of from about 10.0 to about 14.0 carbon atoms; and further, wherein L has no substituents other than A, $R^1$ and $R^2$; $R^1$ is $C_1$–$C_3$ alkyl (preferably $C_1$–$C_2$ alkyl, more preferably methyl); $R^2$ is selected from H and $C_1$–$C_3$ alkyl provided that in at least about 0.5 mole fraction of said enhanced alkylbenzene, $R^2$ is H); A is a (nonsulfonated) benzene moiety ($C_6H_5$— having no substituents other than L); and (b) from about 40% to about 75% by weight of a mixture of modified unsubstituted alkylbenzenes having formula (II):

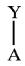

wherein A is a (nonsulfonated) benzene moiety ($C_6H_5$— having no substituents other than L) and Y is a linear aliphatic moiety having no substituents other than A consisting of carbon and hydrogen having two methyl termini, and wherein Y has from 9 to 15 carbon atoms in total and said mixture of modified unsubstituted alkylbenzenes has an average aliphatic carbon content (i.e., carbon content excluding A) of from about 10.0 to about 14.0 carbon atoms; and wherein said modified unsubstituted alkylbenzene mixture is further characterized by a 2/3-phenyl index of from about 275 to about 10,000, and a 2-methyl-2-phenyl index of less than about 0.3.

In accordance with other embodiments of the present invention, there are encompassed herein a number of alternate and less preferred embodiments, such as those in which there is blending of the enhanced alkylbenzene sulfonate surfactant mixture of the invention with one or more other alkylbenzene sulfonate surfactants. In practical terms, such blending is usually encompassed before sulfonation and detergent formulation, but the outcome is a surfactant mixture or detergent composition containing a blend of the enhanced alkylbenzene sulfonate surfactant with other, known, alkylbenzene sulfonates. Such alternate embodiments of the invention nonlimitingly include those termed herein as "medium 2/3-phenyl surfactant mixtures". Such surfactant mixtures essentially contain useful amounts of the enhanced alkylbenzene sulfonate surfactant, along with other known alkylbenzene sulfonates subject to specific provisions of the 2/3-phenyl index of the overall composition. Such compositions include: a medium 2/3-phenyl surfactant mixture consisting essentially of: from 1% to about 60% by weight of a first alkylbenzene sulfonate surfactant, wherein said first alkylbenzene sulfonate surfactant is an enhanced alkylbenzene sulfonate surfactant mixture according to the first embodiment; and b) from 40% to about 99% by weight of a second alkylbenzene sulfonate surfactant, wherein said second alkylbenzene sulfonate surfactant is an alkylbenzene sulfonate surfactant mixture other than said enhanced alkylbenzene sulfonate surfactant mixture according to the first embodiment, and wherein said second alkylbenzene sulfonate surfactant has a 2/3-phenyl index of from about 75 to about 160 (typically said second alkylbenzene sulfonate surfactant is a commercial $C_{10}$–$C_{14}$ linear alkylbenzene sulfonate surfactant, e.g., DETAL® process LAS or HF process LAS though in general any commercial linear (LAS) or branched (ABS, TPBS) type can be used); provided that said medium 2/3-phenyl surfactant mixture has a 2/3-phenyl index of from about 160 to about 275. Of course, it is equally possible within the spirit and scope of the invention to prepare any blend of the enhanced alkylbenzene sulfonate surfactant mixture of the invention with any known commercial linear or branched alkylbenzene sulfonate surfactant.

Preferred cleaning composition embodiments also contain specific cleaning adjuncts defined hereafter. Moreover, the invention encompasses less preferred but sometimes useful embodiments for their normal purposes, such as the addition of useful hydrotrope precursors and/or hydrotropes, such as $C_1$–$C_8$ alkylbenzenes, more typically toluenes, cumenes, xylenes, naphthalenes, or the sulfonated derivatives of any such materials, minor amounts of any other materials, such as tribranched alkylbenzene sulfonate surfactants, dialkylbenzenes and their derivatives, dialkyl tetralins, wetting agents, processing aids, and the like. It will be understood that, with the exception of hydrotropes, it will not be usual practice in the present invention to include any such materials. Likewise it will be understood that such materials, if and when they interfere with analytical methods, will not be included in samples of compositions used for analytical purposes.

The abovementioned embodiments and other aspects of the present invention are more fully described and exemplified in the detailed description hereinafter.

All percentages, ratios and proportions herein are by weight, unless otherwise specified. All temperatures are in degrees Celsius (° C.) unless otherwise specified. All documents cited are in relevant part, incorporated herein by reference.

DETAILED DESCRIPTION OF THE INVENTION

First Embodiment

A. Enhanced Alkylbenzene Sulfonate Surfactant Mixtures

The present invention encompasses an enhanced alkylbenzene sulfonate surfactant mixture comprising (preferably, consisting essentially of): (a) from about 60% to about 25% by weight, preferably from about 55% to about 35%, more preferably from about 50% to about 40% of a mixture of enhanced alkylbenzene sulfonates having formula (I):

(I)

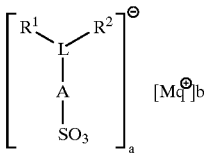

wherein L is an acyclic aliphatic moiety consisting of carbon and hydrogen, said L having two methyl termini and said L having no substituents other than A, $R^1$ and $R^2$; and wherein said mixture of enhanced alkylbenzene sulfonates contains two or more (preferably at least three, optionally more) of said enhanced alkylbenzene sulfonates differing in molecular weight of the anion of said formula (I) and wherein said mixture of enhanced alkylbenzene sulfonates has a sum of carbon atoms in $R^1$, L and $R^2$ of from 9 to 15 (preferably from 10 to 14); an average aliphatic carbon content (i.e., based on $R^1$, L and $R^2$ and excluding A) of from about 10.0 to about 14.0 carbon atoms (preferably from about 10.5 to about 12.5, more preferably from about 11.0 to about 12.0); M is a cation or cation mixture (preferably selected from H, Na, K, Ca, Mg and mixtures thereof, more preferably selected from H, Na, K and mixtures thereof, more preferably still, selected from H, Na, and mixtures thereof) having a valence q (typically from 1 to 2, preferably 1); a and b are integers selected such that said enhanced alkylbenzene sulfonates are electroneutral (a is typically from 1 to 2, preferably 1, b is 1); $R^1$ is $C_1$–$C_3$ alkyl (preferably $C_1$–$C_2$ alkyl, more preferably methyl); $R^2$ is selected from H and $C_1$–$C_3$ alkyl (preferably H and $C_1$–$C_2$ alkyl, more preferably H and methyl, more preferably H and methyl provided that in at least about 0.5, more preferably 0.7, more preferably 0.9 to 1.0 mole fraction of said enhanced alkylbenzene sulfonates, $R^2$ is H); A is a benzene moiety (typically A is the moiety —$C_6H_4$—, with the $SO_3$ moiety of Formula (I) in para-position to the L moiety, though in some proportion, usually no more than about 5%, preferably from 0 to 5% by weight, the $SO_3$ moiety is ortho- to L); and (b) from about 40% to about 75% by weight, preferably from about 45% to about 65%, more preferably from about 50% to about 60% of a mixture of modified unsubstituted alkylbenzene sulfonates having formula (II):

(II)

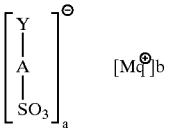

wherein a, b, M, A and q are as defined hereinbefore and Y is a linear aliphatic moiety having no substituents other than A consisting of carbon and hydrogen having two methyl termini, and wherein said Y has a sum of carbon atoms of from 9 to 15, preferably from 10 to 14, and said Y has an average aliphatic carbon content of from about 10.0 to about 14.0 (preferably from about 10.5 to about 12.5, more preferably 11.0 to about 12.0 carbon atoms); and wherein said modified unsubstituted alkylbenzene sulfonate is further characterized by a 2/3-phenyl index of from about 275 to about 10,000, preferably from about 300 to about 5,000, more preferably from about 325 to about 2,500.

A preferred modified unsubstituted alkylbenzene sulfonate has M selected from H, Na, K and mixtures thereof, said a=1, said b=1, said q=1, and said enhanced alkylbenzene sulfonate surfactant mixture has a 2-methyl-2-phenyl index of less than about 0.3, preferably less than about 0.2, more preferably from 0 to about 0.1.

Such an enhanced alkylbenzene sulfonate surfactant mixture according to the first embodiment can be made as the product of a process using as alkylation catalyst a zeolite selected from mordenite, offretite and H-ZSM-12 in at least partially acidic form, preferably an acidic mordenite. Moreover, any alkylation catalyst that exhibits the same or similar characteristics as those of mordenite, under the same or similar conditions, may be employed in the process of making the enhanced alkylbenzene surfactant mixture according to the first embodiment. For instance, certain forms of zeolite beta that exhibit the same or similar characteristics as those of mordenite under the same or similar conditions may be employed as an alternative to mordenite, but are not highly preferred. Embodiments described in terms of their making, as well as suitable catalysts, are all further detailed hereinafter.

Another preferred enhanced alkylbenzene sulfonate surfactant mixture according to the first embodiment of the invention consists essentially of said mixture of enhanced alkylbenzene sulfonates and modified unsubstituted alkylbenzene sulfonates, wherein said 2-methyl-2-phenyl index of said enhanced alkylbenzene sulfonate surfactant mixture is less than about 0.1, and wherein in said mixture of enhanced and modified unsubstituted alkylbenzene sulfonates, said average aliphatic carbon content is from about 11.0 to about 12.0 carbon atoms; said $R^1$ is methyl; said $R^2$ is selected from H and methyl provided that in at least about 0.7 mole fraction of said enhanced alkylbenzene sulfonates $R^2$ is H; and wherein said sum of carbon atoms in $R^1$, L and $R^2$ is from 10 to 14; and further wherein in said mixture of modified unsubstituted alkylbenzene sulfonates, said Y has a sum of carbon atoms of from 10 to 14 carbon atoms, said average aliphatic carbon content of said modified unsubstituted alkylbenzene sulfonates is from about 11.0 to about 12.0 carbon atoms, and said M is a monovalent cation or cation mixture selected from H, Na and mixtures thereof.

Definitions

Methyl Termini

The terms "methyl termini" and/or "terminal methyl" mean the carbon atoms that are the terminal carbon atoms in alkyl moieties, that is L, and/or Y of formula (I) and formula (II) respectively are always bonded to three hydrogen atoms. That is, they will form a $CH_3$— group. To better explain this, the structure below shows the two terminal methyl groups in an alkylbenzene sulfonate.

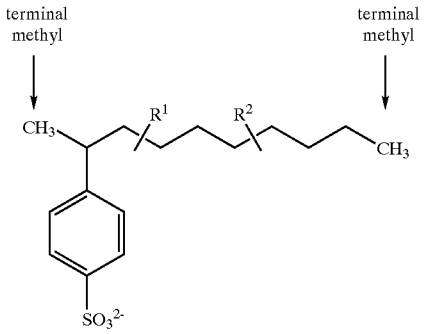

The term "AB" herein when used without further qualification is an abbreviation for "alkylbenzene" of the so-called "hard" or nonbiodegradable type, which on sulfonation forms "ABS". The term "LAB" herein is an abbreviation for "linear alkylbenzene" of the current commercial, more biodegradable type, which on sulfonation forms linear alkylbenzene sulfonate, or "LAS". The term "MLAS" herein is an abbreviation for the enhanced alkylbenzene sulfonate surfactant mixtures of the invention.

Impurities

The enhanced alkylbenzene sulfonate surfactant mixtures herein are preferably substantially free from impurities selected from tribranched impurities, dialkyl tetralin impurities and mixtures thereof. By "substantially free" it is meant that the amounts of such impurities are insufficient to contribute positively or negatively to the cleaning effectiveness of the composition. Typically there is less than about 5%, preferably less than about 1%, more preferably about 0.1% or less of the impurity, that is typically no one of the impurities with practical analytical detection limits.

Illustrative Structures

The better to illustrate the possible complexity of the enhanced alkylbenzene sulfonate surfactant mixtures of the invention and the resulting detergent compositions, structures (a) to (v) below are illustrative of some of the many preferred compounds of formula (I). These are only a few of hundreds of possible preferred structures that make up the bulk of the composition, and should not be taken as limiting of the invention.

(a)

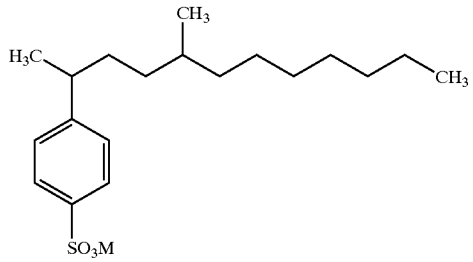

(b)

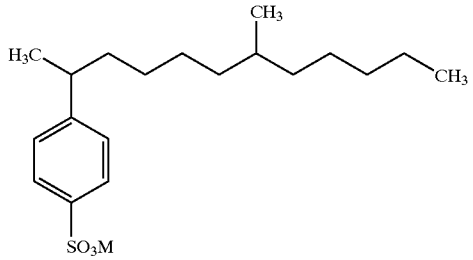

(c)

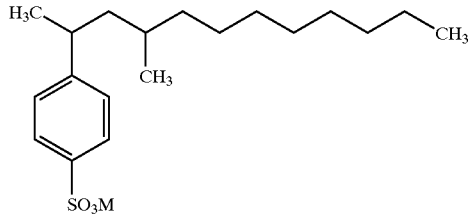

(d)

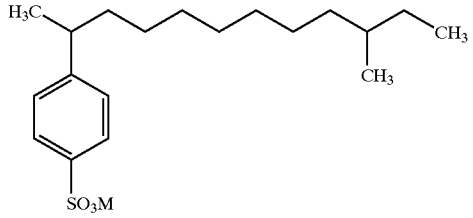

(e)

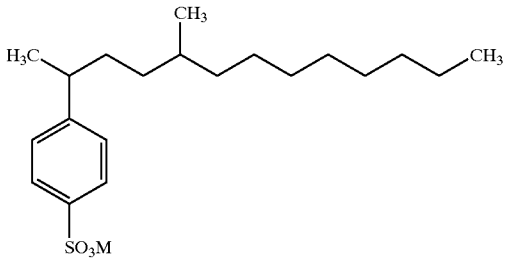

(f)

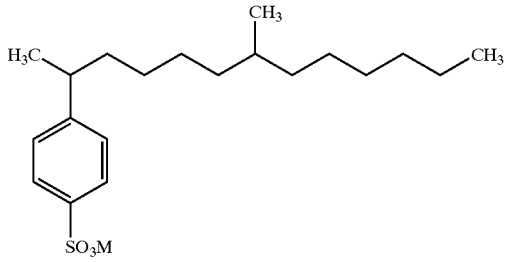

-continued
(g)
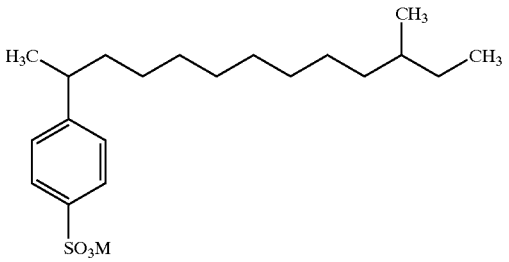
(h)
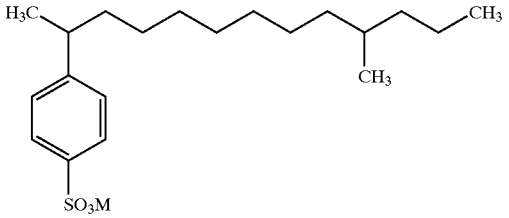
(i)
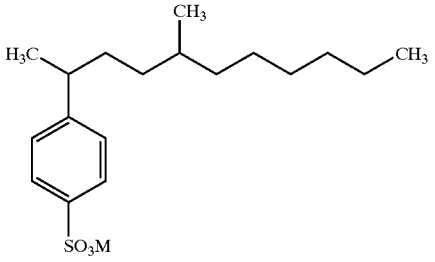
(j)
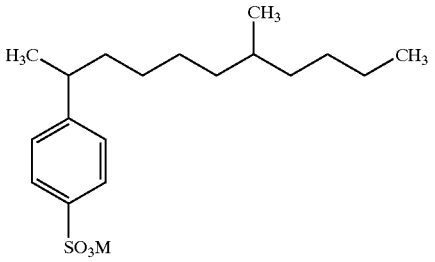
(k)
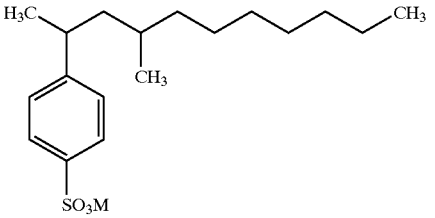
(l)
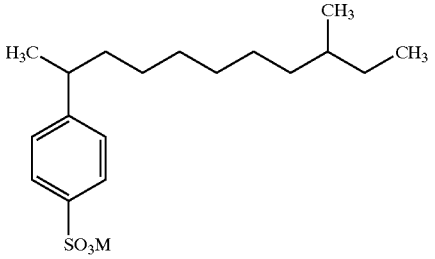
-continued
(m)
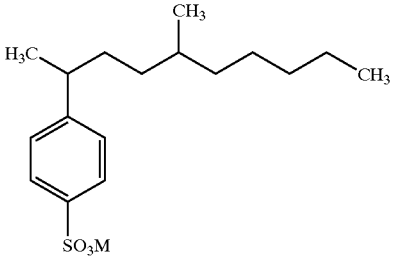
(n)
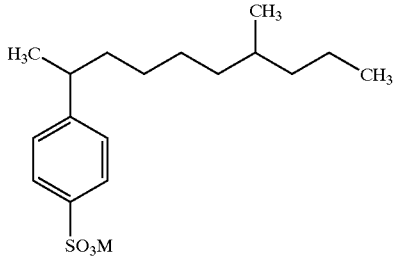
(o)
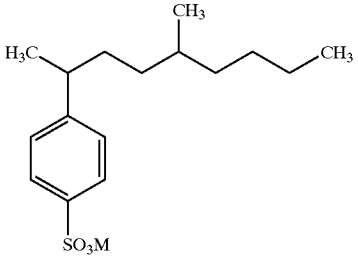
(p)
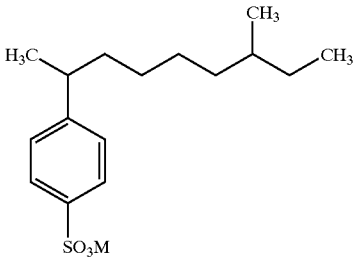
(q)
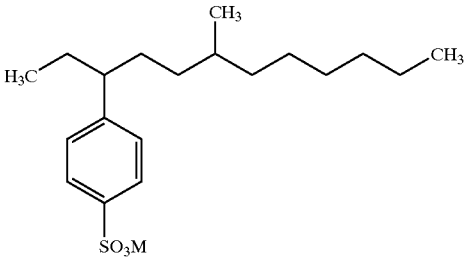
(r)
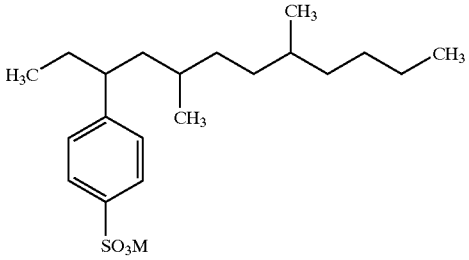

-continued (s)

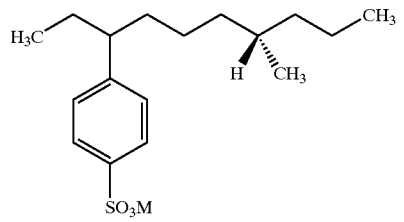

(t)

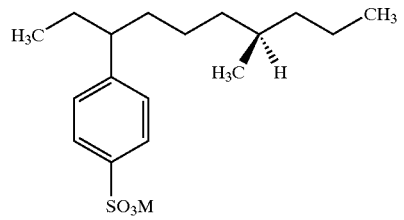

(u)

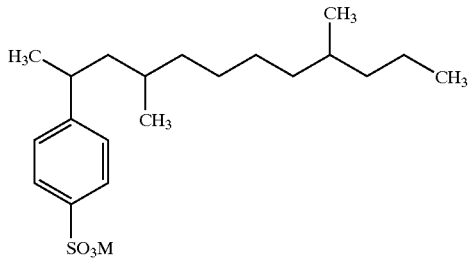

(v)

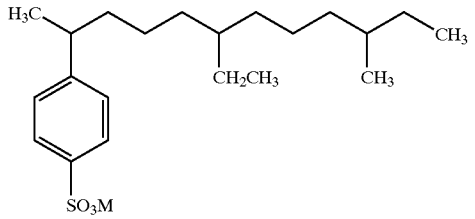

Structures (w) and (x) nonlimitingly illustrate less preferred compounds of Formula (I) which can be present, at lower levels than the above-illustrated preferred types of structures, in the enhanced alkylbenzene sulfonate surfactant mixtures of the invention and the resulting detergent compositions.

(w)

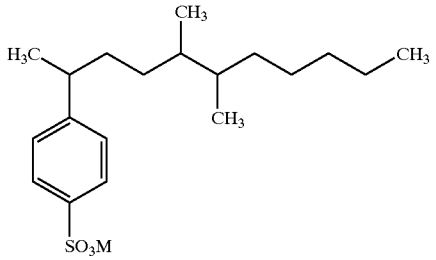

-continued (x)

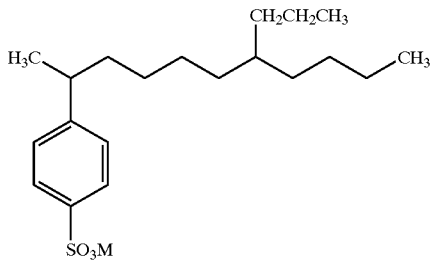

Structures (y), (z), and (aa) nonlimitingly illustrate compounds broadly within Formula (I) that are not preferred but which can be present in the enhanced alkylbenzene sulfonate surfactant mixtures of the invention and the resulting detergent compositions.

(y)

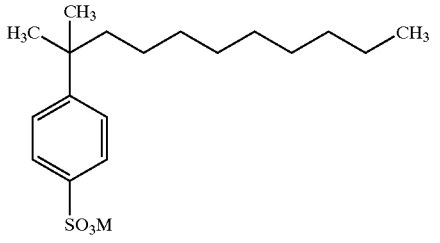

(z)

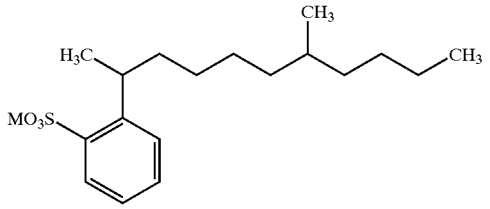

(aa)

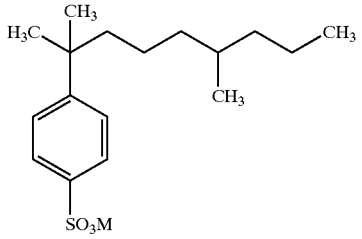

(bb)

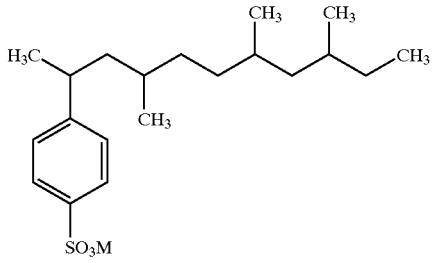

-continued (cc)

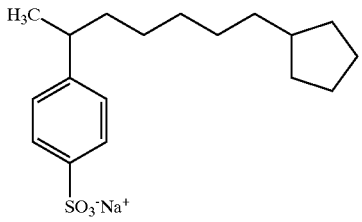

(dd)

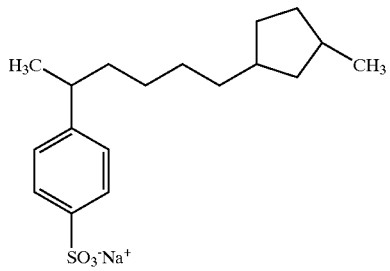

(ee)

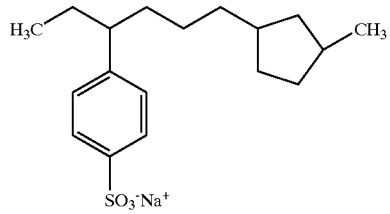

Structure (bb) is illustrative of a tri-branched structure not within Formula (I), but that can be present as an impurity. Structures (cc), (dd) and (ee) are illustrative of structures not within Formula (I), but that can be present as impurities.

First Embodiment

B. Enhanced Alkylbenzene Sulfonate Surfactant Mixtures Defined on the Basis of their Preparation Preferably the enhanced alkylbenzene sulfonate surfactant mixtures herein are the product of sulfonating the corresponding enhanced alkylbenzene mixtures, wherein the enhanced alkylbenzene is produced by alkylating benzene with a substituted olefin, and more particularly the lightly substituted types described in more detail hereinafter, over an acidic mordenite-type catalyst, or other suitable catalyst as defined elsewhere herein.

In outline, enhanced alkylbenzene sulfonate surfactant mixtures herein can be made by the steps of:

(I) alkylating benzene with an alkylating mixture;

(II) sulfonating the product of (I); and (optionally but very preferably)

(III) neutralizing the product of (II).

Provided that suitable alkylation catalysts and process conditions as taught herein are used, the product of step (I) is an enhanced alkylbenzene mixture in accordance with the invention. Provided that sulfonation is conducted under conditions generally known and reapplicable from LAS manufacture, see for example the literature references cited herein, the product of step (II) is an enhanced alkylbenzene sulfonic acid mixture in accordance with the invention. Provided that neutralization step (III) is conducted as generally taught herein, the product of step (III) is an enhanced alkylbenzene sulfonate surfactant mixture in accordance with the invention. Since neutralization can be incomplete, mixtures of the acid and neutralized forms of the present enhanced alkylbenzene sulfonate surfactant mixtures in all proportions, e.g., from about 1000:1 to 1:1000 by weight are also part of the present invention. Preferably, said alkylating mixture contains said branched $C_9$–$C_{20}$ monoolefins having at least two different carbon numbers in said $C_9$–$C_{20}$ range, and has a mean carbon content of from about 9.0 to about 15.0 carbon atoms; and wherein said components (a) and (b) are at a weight ratio of at least about 15:85.

Preferred enhanced alkylbenzene sulfonate surfactant mixtures herein comprise the product of a process comprising the steps of: (I) alkylating benzene with an alkylating mixture; (II) sulfonating the product of (I); and (optionally but very preferably) (III) neutralizing the product of (II); wherein said alkylating mixture comprises: (a) from about 1% to about 99.9%, by weight of methyl-substituted $C_9$–$C_{15}$ (preferably $C_{10}$–$C_{14}$) monoolefins, said substituted monoolefins having structures identical with those of the substituted monoolefins formed by dehydrogenating substituted paraffins of formula $R^1$ $LR^2$ wherein L is an acyclic aliphatic moiety consisting of carbon and hydrogen and containing two terminal methyls; $R^1$ is $C_1$ to $C_3$ alkyl; and $R^2$ is selected from H and $C_1$ to $C_3$ alkyl; and (b) from about 0.1% to about 85%, by weight of $C_9$–$C_{15}$ (preferably $C_{10}$–$C_{14}$) linear aliphatic olefins; wherein said alkylating mixture contains said methyl-substituted $C_9$–$C_{15}$ monoolefins having at least two different carbon numbers in said $C_9$–$C_{15}$ range, and has a mean carbon content of from about 9.0 to about 15.0 carbon atoms (preferably from about 10.0 to about 14.0, more preferably from about 10.5 to about 12.5, more preferably still from about 11.0 to about 12.0); and wherein said components (a) and (b) are at a weight ratio of at least about 15:85 (preferably having methyl-substituted component (a) & modified unsubstituted component (b) in a performance and biodegradation optimum ratio, for example from 25% to 60% of (a) and 40% to 75% of (b), more preferably 35% to 55% of (a) and 45% to 65% of (b), more preferably still 40% to 50% of (a) and 50% to 60% of (b), wherein these percentages by weight exclude any other materials, for example diluent hydrocarbons, that may be present in the process). Said monoolefins (a) or (b) may be internal monoolefins, alpha-olefins, and/or mixtures thereof.

may be diluted with certain materials selected from paraffins and inert, non-paraffinic solvents. Further, the resultant olefin/paraffin mixture may be obtained via the dehydrogenation of a paraffin mixture obtained from kerosene feed stock via a molecular sieving unit designed to isolate a mixture, consisting mainly of both linear and monomethyl branched paraffins from cyclic and dimethyl branched paraffins. Said mixture is blended, if needed, to achieve a linear content of 40% to 75%.

In yet another preferred embodiment, the invention encompasses an enhanced alkylbenzene sulfonate surfactant mixture prepared in accordance with the above-outlined steps wherein said alkylating mixture may be obtained via any one of the following:

1) Dimerization of short chain olefin mixtures inside a molecular sieve

2) Oligomerization of short chain olefin mixtures inside a molecular sieve

3) Product of cracking long-chain hydrocarbon waxes under conditions to obtain a mainly mono methyl branched olefin product;

4) Dehydrogenation of a paraffin mixture obtained from a gas to liquids (GTL) plant.

Other enhanced alkylbenzene sulfonate surfactant mixtures herein are made by the above-outlined processes wherein in step (I), said alkylation is performed in the presence of an alkylation catalyst, said alkylation catalyst is an intermediate acidity solid porous alkylation catalyst, and step (II) comprises removal of components other than monoalkylbenzene prior to contacting the product of step (I) with sulfonating agent.

Also encompassed is the enhanced alkylbenzene sulfonate surfactant mixture according to the above-defined processes wherein said alkylation catalyst is other than a member selected from the group consisting of HF, $AlCl_3$, sulfuric acid and mixtures thereof. Such is the case when the alkylation catalyst is selected from the group consisting of non-fluoridated acidic mordenite-type catalyst, fluoridated acidic mordenite-type catalyst and mixtures thereof.

The processes are tolerant of variation, for example conventional steps can be added before, in parallel with, or after the outlined steps (I), (II) and (III). This is especially the case for accommodating the use of hydrotropes or their precursors. Thus the invention encompasses an enhanced alkylbenzene sulfonate surfactant mixture according to the above-outlined processes wherein a hydrotrope, hydrotrope precursor, or mixtures thereof is added after step (I); or the hydrotrope, hydrotrope precursor or mixtures thereof is added during or after step (II) and prior to step (m); or a hydrotrope can be added during or after step In certain cases, compositions herein can also be prepared by blending. Thus, the invention includes a detergent composition using an enhanced alkylbenzene sulfonate surfactant blend according to the first embodiment wherein said enhanced alkylbenzene sulfonate surfactant mixture is prepared by a process comprising a step selected from: (i) blending a mixture of enhanced and modified unsubstituted alkylbenzene sulfonate surfactants having a 2/3-phenyl index of 500 to 700 with an alkylbenzene sulfonate surfactant mixture having a 2/3-phenyl index of 75 to 160 and (ii) blending a mixture of methyl-substituted and modified unsubstituted alkylbenzenes having a 2/3-phenyl index of 500 to 700 with an alkylbenzene mixture having a 2/3-phenyl index of 75 to 160 and sulfonating said blend.

Sulfonation and Workup or Neutralization (Steps II/III)

In general, sulfonation of the enhanced alkylbenzene mixture in the instant process can be accomplished using any of the well-known sulfonation systems, including those described in "Detergent Manufacture Including Zeolite Builders and other New Materials", Ed. Sittig., Noyes Data Corp., 1979, as well as in Vol. 56 in "Surfactant Science" series, Marcel Dekker, New York, 1996, including in particular Chapter 2 entitled "Alkylarylsulfonates: History, Manufacture, Analysis and Environmental Properties", pages 39–108 which includes 297 literature references. This work provides access to a great deal of literature describing various processes and process steps, not only sulfonation but also dehydrogenation, alkylation, alkylbenzene distillation and the like. Common sulfonation systems useful herein include sulfuric acid, chlorosulfonic acid, oleum, sulfur trioxide and the like. Sulfur trioxide/air is especially preferred. Details of sulfonation using a suitable air/sulfur trioxide mixture are provided in U.S. Pat. No. 3,427,342, Chemithon. Sulfonation processes are further extensively described in "Sulfonation Technology in the Detergent Industry", W. H. de Groot, Kluwer Academic Publishers, Boston, 1991.

Any convenient workup steps may be used in the present process. Common practice is to neutralize after sulfonation with any suitable alkali. Thus the neutralization step can be conducted using alkali selected from sodium, potassium, ammonium, magnesium and substituted ammonium alkalis and mixtures thereof. Potassium can assist solubility, magnesium can promote soft water performance and substituted ammonium can be helpful for formulating specialty variations of the instant surfactants. The invention encompasses any of these derivative forms of the enhanced alkylbenzene sulfonate surfactant mixtures as produced by the present process and their use in consumer product compositions.

Alternately the acid form of the present surfactants can be added directly to acidic cleaning products, or can be mixed with cleaning ingredients and then neutralized.

The hydrotropes or hydrotrope precursors useful herein can in general be selected from any suitable hydrotrope or hydrotrope precursor, including lower alkyl ($C_1$–$C_8$) aromatics and their sulfonic acids and sulfonate salts, but are more typically based on a sulfonic acid or sodium sulfonate salt of toluene, cumene, xylene, napthalene or mixtures thereof. The hydrotrope precursors are selected from any suitable hydrotrope precursor, typically toluene, cumene, xylene, napthalene or mixtures thereof. A hydrotrope precursor is a compound that during step (III), namely the sulfonation step, is converted into a hydrotrope.

Moreover, it is contemplated that the alkylation "step" (I) herein can be "staged" so that two or more reactors operating under different conditions in the defined ranges may be useful. By operating a plurality of such reactors, it is possible to allow for material with less preferred 2-methyl-2-phenyl index to be initially formed and, surprisingly, to convert such material into material with a more preferred 2-methyl-2-phenyl index.

In terms of sulfonating agent selection, the invention encompasses an enhanced alkylbenzene sulfonate surfactant mixture wherein step (II) is performed using a sulfonating agent selected from the group consisting of sulfur trioxide, sulfur trioxide/air mixtures, and sulfuric acid (including oleum). Chlorosulfonic acid or other known sulfonating agents, while less commercially relevant, are also useful and are included for use in the invention.

Although in general, neutralization step (III) can be carried out with any suitable alkali, the invention includes an enhanced alkylbenzene sulfonate surfactant mixture wherein said step (III) is performed using a basic salt, said basic salt having a cation selected from the group consisting of alkali metal, alkaline earth metal, ammonium, substituted ammonium, and mixtures thereof and an anion selected from hydroxide, oxide, carbonate, silicate, phosphate, and mixtures thereof. Preferred basic salt is selected from the group consisting of sodium hydroxide, sodium silicate, potassium hydroxide, potassium silicate, magnesium hydroxide, ammonium hydroxide, and mixtures thereof.

Alkylation Catalyst

To secure the enhanced alkylbenzene sulfonate surfactant mixtures of the invention, the present invention uses a particularly defined alkylation catalyst. Said alkylation catalyst is an intermediate acidity solid porous alkylation catalyst defined in detail hereinafter. Particularly preferred alkylation catalysts comprise at least partially dealuminized acidic non-fluoridated mordenites, at least partially dealuminized acidic fluoridated mordenites, and mixtures thereof. In additional embodiments, a preferred alkylation catalyst is that which exhibits the same or similar characteristics as the mordenite catalyst, under the same or similar conditions. One such catalyst may stem from the group consisting of zeolite beta catalysts, of certain and specific form, but is not preferred.

Numerous alkylation catalysts are unsuitable for making the present enhanced alkylbenzene mixtures and enhanced alkylbenzene sulfonate surfactant mixtures. Unsuitable alkylation catalysts include any of: sulfuric acid, aluminum chloride, and HF. Also unsuitable are non-acidic calcium mordenite, and many others. Other catalysts, such as the DETAL® process catalysts of UOP are also unsuitable, at least in their current commercial executions.

In contrast, suitable alkylation catalysts herein are selected from shape-selective moderately acidic alkylation catalysts, preferably zeolitic. The zeolite catalyst used for the alkylation step (I) is preferably selected from the group consisting of mordenite, HZSM-12, NES and offretite, any of these being in at least partially acidic form. Mixtures can be used and the catalysts can be combined with binders etc. More preferably, the zeolite is substantially in acid form and is contained in a catalyst pellet comprising a conventional binder and further wherein said catalyst pellet comprises at least about 1%, more preferably at least 5%, more typically from 50% to about 90%, of said zeolite.

More generally, a suitable alkylation catalyst is typically at least partially crystalline, more preferably substantially crystalline not including binders or other materials used to form catalyst pellets, aggregates or composites. Moreover the catalyst is typically at least partially acidic. Fully exchanged Ca-form mordenite, for example, is unsuitable whereas H-form mordenite is suitable.

EP 466,558 describes an acidic mordenite type alkylation catalyst also of possible use herein having overall Si/Al atomic ratio of 15–85 (15–60), Na weight content is less than 1000 ppm (preferably less than 250 ppm), and there is a low or zero content of extra-network Al species; the elementary mesh volume as defined in EP 466,558 is below 2,760 $nm^3$.

U.S. Pat. No. 5,057,472 is likewise useful for preparing alkylation catalysts herein and relates to concurrent dealumination and ion-exchange of an acid-stable Na ion-containing zeolite, preferably mordenite, effected by contact of the zeolite with a 0.5–3 (preferably 1–2.5) M $HNO_3$ solution containing sufficient $NH_4NO_3$ to fully exchange the $Na^+$ ions for $NH_4^+$ and $H^+$ ions. The resulting zeolites can have a $SiO_2$:$Al_2O_3$ ratio of 15:1 to 26:1, preferably 17:1 to 23:1, and are preferably calcined to at least partially convert the $NH_4^+/H^+$ form to the $H^+$ form. Optionally, though not necessarily particularly desirable in the present invention, the catalyst can contain a Group VIII metal (and optionally also an inorganic oxide) together with the calcined zeolite of '472.

Another acidic mordenite catalyst useful for the alkylation step herein is disclosed in U.S. Pat. No. 4,861,935 which relates to a hydrogen form of mordenite incorporated with alumina, the composition having a surface area of at least 580 $m^2/g$. Other acidic mordenite catalysts useful for the alkylation step herein include those described in U.S. Pat. Nos. 5,243,116 and 5,198,595. Yet another alkylation catalyst useful herein is described in U.S. Pat. No. 5,175,135 which is an acid mordenite zeolite having a silica/alumina molar ratio of at least 50:1, a Symmetry Index of at least 1.0 as determined by X-ray diffraction analysis, and a porosity such that the total pore volume is in the range from about 0.18 cc/g to about 0.45 cc/g and the ratio of the combined meso- and macropore-volume to the total pore volume is from about 0.25 to about 0.75.

Particularly preferred alkylation catalysts herein include the acidic mordenite catalysts Zeocat™ FM-8/25H available from Zeochem; CBV 90 A available from Zeolyst International, and LZM-8 available from UOP Chemical Catalysts as well as fluoridated versions of the above commercial catalysts. Fluoridated mordenites can be prepared by a number of ways. A method of providing a particularly useful fluoridated mordenite is described in U.S. Pat. No. 5,777,187. The invention encompasses preferred embodiments in which the mordenites are fluoridated, but also has other preferred embodiments in which the mordenites are non-fluoridated.

Most generally, any alkylation catalyst may be used herein provided that the alkylation catalyst can (a) accommodate methyl-substituted olefins as described elsewhere herein into the smallest pore diameter of said catalyst and (b) selectively alkylate benzene with said substituted olefins and optionally mixtures thereof with linear olefins. Acceptable selectivity is in accordance with a 2/3-Phenyl index of about 275 to about 10,000 as defined herein.

In other terms, the catalyst selections herein are made in part with the intention of minimizing internal alkylbenzene formation (e.g., 4-phenyl, 5-phenyl . . . ). The formulators contributing to the present invention have unexpectedly discovered that control of internal alkylbenzene sulfonate isomers in the present inventive surfactant mixtures in conjunction with introduction of limited methyl branching is very helpful for improving their performance. The present invention connects this discovery to discoveries of the synthesis chemists in the present invention, who have determined how to control internal isomer content while providing limited methyl branching in the enhanced alkylbenzene sulfonate surfactant mixtures in accordance with the formulators' prescriptions.

The extent to which internal isomer content needs to be controlled can vary depending on the consumer product application and on whether outright best performance or a balance of performance and cost is required. In absolute terms, the amount of internal isomer such as internal alkylbenzene isomer is preferably always kept below 25% by weight, but for best results, from 0 to 10%, preferably less than about 5% by weight. "Internal alkylbenzene" isomers as defined herein include alkylbenzenes having phenyl attachment to an aliphatic chain in the 4, 5, 6 or 7 position.

Without intending to be limited by theory, there are two reasons for which it is believed that the preferred alkylation catalysts are the above-described shape selective zeolitic type catalysts, especially mordenites. The first reason is to provide the selectivity of formation of preferred compounds such as substituted and unsubstituted 2-phenyl and 3-phenylalkylbenzenes. This selectivity is measured by the 2/3-phenyl index. The second reason is to control the amount of quaternary alkylbenzenes and thus quaternary alkylbenzene sulfonates.

Results with alkylation catalysts such as HF can give quite high levels of quaternary alkylbenzenes as shown in the literature (see J. Org. Chem. Vol. 37, No. 25, 1972). This contrasts with the surprising discovery as part of the present invention that one can attain low levels of quaternary alkylbenzenes in catalyzed reactions of benzene with substituted olefins, as characterized by 2-methyl-2-phenyl index. In practice, some isomerization of the enhanced alkylbenzenes may occur during alkylation, i.e. the ratio of enhanced alkylbenzenes to modified unsubstituted alkylbenzenes may vary.

Second Embodiment

Detergent Compositions

The present invention has numerous detergent composition embodiments, including the detergent composition comprising: (a) from about 1% to about 50%, preferably from about 2% to about 30%, by weight of enhanced alkylbenzene sulfonate surfactant mixture according to the first embodiment, wherein said enhanced alkylbenzene sulfonate surfactant mixture has a 2-methyl-2-phenyl index of less than about 0.3, preferably of from 0 to 0.2, more preferably no more than about 0.1, more preferably still, no more than about 0.05; (b) from about 0.000001% to about 10%, preferably from about 0.01% to about 2%, of a member selected from the group consisting of optical brighteners, dyes, photobleaches, hydrophobic bleach activators and transition metal bleach catalysts, preferably at least two of said member components, more preferably at least two of said member components including an optical brightener as one of the member components; (c) from 0.1% to about 40% by weight (preferably not more than about 30%) of surfactants selected from the group consisting of cationic surfactants, nonionic surfactants, anionic surfactants, and amine oxide surfactants (more preferably at least one cationic surfactant is present at a level of from about 0.2% to about 5% by weight, or at least one nonionic surfactant is present at a level of from about 0.5% to about 25% by weight, or at least one alkyl sulfate surfactant or alkyl(polyalkoxy)sulfate surfactant is present at a level of from about 0.5% to about 25% by weight); and (d) from about 10% to about 99% of conventional cleaning adjuncts (other than any of (a)–(c)); provided that when said detergent composition comprises any alkylbenzene sulfonate surfactant other than said enhanced alkylbenzene sulfonate surfactant mixture (for example as a result of blending into the detergent composition one or more commercial, especially linear, typically linear $C_{10}$–$C_{14}$, alkylbenzene sulfonate surfactants), said detergent composition is further characterized by an overall 2/3-phenyl index of at least about 200, preferably at least about 250, more preferably at least about 350, more preferably still, at least about 500, wherein said overall 2/3-phenyl index is determined by measuring 2/3-phenyl index, as defined herein, on a blend of said enhanced alkylbenzene sulfonate surfactant mixture and said any other alkylbenzene sulfonate to be added to said detergent composition, said blend, for purposes of measurement, being prepared from aliquots of said enhanced alkylbenzene sulfonate surfactant mixture and said other alkylbenzene sulfonate not yet exposed to any other of said components of the detergent composition; and further provided that when said detergent composition comprises any alkylbenzene sulfonate surfactant other than said enhanced alkylbenzene sulfonate surfactant mixture (for example as a result of blending into the detergent composition one or more commercial, especially linear, typically linear $C_{10}$–$C_{14}$, alkylbenzene sulfonate surfactants), said detergent composition is further characterized by an overall 2-methyl-2-phenyl index of less than about 0.3, preferably from 0 to 0.2, more preferably no more than about 0.1, more preferably still, no more than about 0.05, wherein said overall 2-methyl-2-phenyl index is to be determined by measuring 2-methyl-2-phenyl index, as defined herein, on a blend of said enhanced alkylbenzene sulfonate surfactant mixture and any other alkylbenzene sulfonate to be added to said detergent composition, said blend, for purposes of measurement, being prepared from aliquots of said enhanced alkylbenzene sulfonate surfactant mixture and said other alkylbenzene sulfonate not yet exposed to any other of said components of the detergent composition.

These provisions may appear somewhat unusual, however they are consistent with the spirit and scope of the present invention, which encompasses a number of economical but less preferred approaches in terms of overall cleaning performance, such as blending of the enhanced alkylbenzene sulfonate surfactants with conventional linear alkylbenzene sulfonate surfactants either during synthesis or during formulation into the detergent composition. Moreover, as is well known to practitioners of detergent analysis, a number of detergent adjuncts (paramagnetic materials such as certain transition metal bleach catalysts, for example, and sometimes even water) are capable of interfering with methods for determining the parameters of alkylbenzene sulfonate surfactant mixtures as described hereinafter. Hence wherever possible, analysis should be conducted on dry materials before mixing them into the detergent compositions.

Numerous variations of the present detergent compositions are useful. Such variations include:

the detergent composition, which is substantially free from alkylbenzene sulfonate surfactants other than said, enhanced alkylbenzene sulfonate surfactant mixture;

the detergent composition which comprises, in said component (c), at least about 0.1%, preferably no more than about 10%, more preferably no more than about 5%, more preferably still, no more than about 1%, of a commercial $C_{10}$–$C_{14}$ linear alkylbenzene sulfonate surfactant;

said conventional cleaning adjunct which comprises from about 0.1% to about 5% of a cationic surfactant, such as one selected from substituted and unsubstituted $C_8$–$C_{16}$ alkyl ammonium salts;

the detergent composition which comprises, in said component (c), at least about 0.1%, preferably no more than about 10%, more preferably no more than about 5%, more preferably still, no more than about 1%, of a commercial highly branched alkylbenzene sulfonate surfactant. (e.g., TPBS or tetrapropylbenzene sulfonate);

the detergent composition which comprises, in said component (c), a nonionic surfactant at a level of from about 0.5% to about 25% by weight of said detergent composition, and wherein said nonionic surfactant is a polyalkoxylated alcohol in capped or non-capped form having:—a hydrophobic group selected from linear $C_{10}$–$C_{16}$ alkyl, mid-chain $C_1$–$C_3$ branched $C_{10}$–$C_{16}$ alkyl, guerbet branched $C_{10}$–$C_{16}$ alkyl, and mixtures thereof and—a hydrophilic group selected from 1–15 ethoxylates, 1–15 propoxylates 1–15 butoxylates and mixtures thereof, in capped or uncapped form. (when uncapped, there is also present a terminal primary —OH moiety and when capped, there is also present a terminal moiety of the form —OR wherein R is a $C_1$–$C_6$ hydrocarbyl moiety, optionally comprising a primary or, preferably when present, a secondary alcohol.);

the detergent composition which comprises, in said component (c), an alkyl sulfate surfactant at a level of from about 0.5% to about 25% by weight of said detergent composition, wherein said alkyl sulfate surfactant has a hydrophobic group selected from linear $C_{10}$–$C_{18}$ alkyl, mid-chain $C_1$–$C_3$ branched $C_{10}$–$C_{18}$ alkyl, guerbet branched $C_{10}$–$C_{18}$ alkyl, and mixtures thereof and a cation selected from Na, K and mixtures thereof;

the detergent composition which comprises, in said component (c), an alkyl(polyalkoxy)sulfate surfactant at a level of from about 0.5% to about 25% by weight of said detergent composition, wherein said alkyl(polyalkoxy) sulfate surfactant has—a hydrophobic group selected from linear $C_{10}$–$C_{16}$ alkyl, mid-chain $C_1$–$C_3$ branched $C_{10}$–$C_{16}$ alkyl, guerbet branched $C_{10}$–$C_{16}$ alkyl, and mixtures thereof and—a (polyalkoxy)sulfate hydrophilic group selected from 1–15 polyethoxysulfate, 1–15 polypropoxysulfate, 1–15 polybutoxysulfate, 1–15 mixed poly(ethoxy/propoxy/butoxy)sulfates, and mixtures thereof, in capped or uncapped form; and—a cation selected from Na, K and mixtures thereof;

the detergent composition having the form of a heavy-duty liquid detergent;

the detergent composition having the form of a syndet laundry bar;

the detergent composition having the form of a heavy-duty granule;

the detergent composition having the form of a heavy-duty granule and wherein said conventional cleaning adjunct (d) comprises from about 10% to about 50% by weight of said detergent composition of a nonphosphate builder;

the detergent composition having the form of a heavy-duty granule and wherein said conventional cleaning adjunct (d) comprises from about 10% to about 50% by weight of said detergent composition of a phosphate builder; and the detergent composition having the form of a heavy-duty granule and wherein said conventional cleaning adjunct (d) comprises as said phosphate builder a member selected from the group consisting of sodium tripolyphosphate.

Further the present invention includes a detergent composition comprising (preferably consisting essentially of): (a) from about 0.1% to about 95%, by weight (preferably from about 0.5% to about 50%, more preferably from about 1%, preferably at least 2%, more preferably at least 4%, more preferably at least 6%, more preferably still at least 8% to about 35%) of enhanced alkylbenzene sulfonate surfactant mixture according to the invention; (b) from about 0.00001% to about 99.9% (preferably from about 5% to about 98%, more preferably from about 50% to about 95%) of conventional cleaning adjuncts other than surfactants; and (c) from 0% to about 50%, by weight (in some preferred embodiments, 0%, and in others preferably from about 0.1% to about 30%, more typically from about 0.2% to about 10%), of a surfactant other than said enhanced alkylbenzene sulfonate surfactant mixture; provided that when said detergent composition comprises any other alkylbenzene sulfonate than the alkylbenzene sulfonate of said enhanced alkylbenzene sulfonate surfactant mixture, said enhanced alkylbenzene sulfonate surfactant mixture and said other alkylbenzene sulfonate, as a mixture, have an overall 2/3-phenyl index of from about 275 to 10,000, preferably from about 300 to about 5,000, more preferably from about 325 to about 2,5000.

In another detergent embodiment, there is encompassed herein a detergent composition comprising: (a) from about 0.1% to about 95%, by weight (preferably from about 0.5% to about 50%, more preferably from about 1% to about 35%) of enhanced alkylbenzene sulfonate surfactant mixture of the invention; (b) from about 0.00001% to about 99.9% (preferably from about 5% to about 98%, more preferably from about 50% to about 95%) of conventional cleaning adjuncts other than surfactants; and (c) from 0.1% to about 50%, by weight (preferably from about 0.1% to about 35%, more typically from about 1% to about 15%) of surfactants other than alkylbenzene sulfonates (preferably, one or more surfactants selected from the group consisting of cationic surfactants, anionic surfactants, and anionic surfactants other than alkylbenzene sulfonates, more preferably wherein a cationic surfactant is present, said cationic surfactant is at a level of from about 0.2% to about 5%).

The invention also includes a detergent composition consisting essentially of: (a) from about 1% to about 50% (preferably from about 1% to about 35%), by weight of enhanced alkylbenzene sulfonate surfactant mixture according to the first embodiment of the invention; (b) from about 0.00001% to about 99.9% (preferably from about 5% to about 98%, more preferably from about 50% to about 95%) of conventional cleaning adjuncts other than surfactants; and (c) from 0.1% to about 50% (preferably from about 0.1% to about 35%, more typically from about 1% to about 15%) by weight of surfactants other than alkylbenzene sulfonates (preferably, one or more surfactants selected from the group consisting of cationic surfactants, anionic surfactants, and anionic surfactants other than alkylbenzene sulfonates, more preferably wherein a cationic surfactant is present at a level of from about 0.2% to about 5%); and (d) from 0.1% to about 95% water.

Likewise part of the invention is a detergent composition consisting essentially of: (a) from about 0.1% to about 95%, by weight of enhanced alkylbenzene sulfonate surfactant mixture according to the first embodiment; and (b) from about 0.00001% to about 99.9% of conventional cleaning adjuncts other than surfactants.

More generally, detergent compositions can include the enhanced alkylbenzene sulfonate surfactant mixtures together with any conventional cleaning adjunct other than surfactants, such as those wherein the adjunct is selected from the group consisting of builders, detersive enzymes, bleaching systems, brighteners, at least partially water-soluble or water dispersible polymers, abrasives, bactericides, tarnish inhibitors, dyes, solvents, hydrotropes, perfumes, thickeners, antioxidants, processing aids, suds boosters, suds suppressors, buffers, anti-fungal agents, mildew control agents, insect repellents, anti-corrosive aids, chelants and mixtures thereof.

The compositions in accordance with the invention can take a variety of physical forms including granular, gel, tablet, bar and liquid forms. The compositions include the so-called concentrated granular detergent compositions adapted to be added to a washing machine by means of a dispensing device placed in the machine drum with the soiled fabric load.

The mean particle size of the components of granular compositions in accordance with the invention should preferably be such that no more that 5% of particles are greater than 1.7 mm in diameter and not more than 5% of particles are less than 0.15 mm in diameter.

The term mean particle size as defined herein is calculated by sieving a sample of the composition into a number of fractions (typically 5 fractions) on a series of Tyler sieves. The weight fractions thereby obtained are plotted against the aperture size of the sieves. The mean particle size is taken to be the aperture size through which 50% by weight of the sample would pass.

Certain preferred granular detergent compositions in accordance with the present invention are the high-density types, now common in the marketplace; these typically have a bulk density of at least 600 g/liter, more preferably from 650 g/liter to 1200 g/liter.

High Density Detergent Composition Processes

Various means and equipment are available to prepare high density (i.e., greater than about 550, preferably greater than about 650, grams/liter or "g/l"), high solubility, free flowing, granular detergent compositions according to the present invention. Current commercial practice in the field employs spray-drying towers to manufacture granular laundry detergents that often have a density less than about 500 g/l. In this procedure, an aqueous slurry of various heat-stable ingredients in the final detergent composition are formed into homogeneous granules by passage through a spray-drying tower, using conventional techniques, at temperatures of about 175° C. to about 225° C. However, if spray drying is used as part of the overall process herein, additional or alternative process steps as described hereinafter must be used to obtain the level of density (i.e., >650 g/l) required by modern compact, low dosage detergent products.

For example, spray-dried granules from a tower can be densified further by loading a liquid such as water or a nonionic surfactant into the pores of the granules and/or subjecting them to one or more high-speed mixer/densifiers. A suitable high speed mixer/densifier for this process is a device marketed under the tradename "Lödige CB 30" or "L ödige CB 30 Recycler" which comprises a static cylindrical mixing drum having a central rotating shaft with mixing/cutting blades mounted thereon. In use, the ingredients for the detergent composition are introduced into the drum and the shaft/blade assembly is rotated at speeds in the range of 100–2500 rpm to provide thorough mixing/densification. See Jacobs et al, U.S. Pat. No. 5,149,455, issued Sep. 22, 1992, and U.S. Pat. No. 5,565,422, issued Oct. 15, 1996 to Del Greco et al. Other such apparatus includes the devices marketed under the tradename "Shugi Granulator" and under the tradename "Drais K-TTP 80).

Another process step which can be used to densify further spray-dried granules involves treating the spray-dried granules in a moderate speed mixer/densifier. Equipment such as that marketed under the tradename "Lödige KM" (Series 300 or 600) or "Lödige Ploughshare" mixer/densifiers are suitable for this process step. Such equipment is typically operated at 40–160 rpm. The residence time of the detergent ingredients in the moderate speed mixer/densifier is from about 0.1 to 12 minutes conveniently measured by dividing the steady state mixer/densifier weight by the throughput (e.g., Kg/hr). Other useful equipment includes the device which is available under the tradename "Drais K-T 160". This process step which employs a moderate speed mixer/densifier (e.g. Lödige KM) can be used by itself or sequentially with the aforementioned high-speed mixer/densifier (e.g. Löidige CB) to achieve the desired density. Other types of granules manufacturing apparatus useful herein include the apparatus disclosed in U.S. Pat. No. 2,306,898, to G. L. Heller, Dec. 29, 1942.

While it may be more suitable to use the high-speed mixer/densifier followed by the low speed mixer/densifier, the reverse sequential mixer/densifier configuration also can be used. One or a combination of various parameters including residence times in the mixer/densifiers, operating temperatures of the equipment, temperature and/or composition of the granules, the use of adjunct ingredients such as liquid binders and flow aids, can be used to optimize densification of the spray-dried granules in the process of the invention. By way of example, see the processes in Appel et al, U.S. Pat. No. 5,133,924, issued Jul. 28, 1992; Delwel et al, U.S. Pat. No. 4,637,891, issued Jan. 20, 1987; Kruse et al, U.S. Pat. No. 4,726,908, issued Feb. 23, 1988; and, Bortolotti et al, U.S. Pat. No. 5,160,657, issued Nov. 3, 1992.

In those situations in which particularly heat sensitive or highly volatile detergent ingredients are to be incorporated into the final detergent composition, processes which do not include spray drying towers are preferred. The formulator can eliminate the spray-drying step by feeding, in either a continuous or batch mode, starting detergent ingredients directly into mixing equipment that is commercially available. One particularly preferred embodiment involves charging a surfactant paste and an anhydrous material into a high-speed mixer/densifier (e.g. Lödige CB) followed by a moderate speed mixer/densifier (e.g. Lödige KM) to form high-density detergent agglomerates. See Capeci et al, U.S. Pat. No. 5,366,652, issued Nov. 22, 1994 and Capeci et al, U.S. Pat. No. 5,486,303, issued Jan. 23, 1996. Optionally, the liquid/solids ratio of the starting detergent ingredients in such a process can be selected to obtain high density agglomerates that are more free flowing and crisp. See Capeci et al, U.S. Pat. No. 5,565,137, issued Oct. 15, 1996.

Optionally, the process may include one or more recycle streams of undersized particles produced by the process that are fed back to the mixer/densifiers for further agglomeration or build-up. The oversized particles produced by this process can be sent to grinding apparatus and then fed back to the mixing/densifying equipment. These additional recycle process steps facilitate build-up agglomeration of the starting detergent ingredients resulting in a finished composition having a uniform distribution of the desired particle size (400–700 microns) and density (>550 g/l). See Capeci et al, U.S. Pat. No. 5,516,448, issued May 14, 1996 and Capeci et al, U.S. Pat. No. 5,489,392, issued Feb. 6, 1996. Other suitable processes which do not call for the use of spray-drying towers are described by Bollier et al, U.S. Pat. No. 4,828,721, issued May 9, 1989; Beerse et al, U.S. Pat. No. 5,108,646, issued Apr. 28, 1992; and, Jolicoeur, U.S. Pat. No. 5,178,798, issued Jan. 12, 1993.

In yet another embodiment, a high-density detergent composition using a fluidized bed mixer. In this process, the various ingredients of the finished composition are combined in an aqueous slurry (typically 80% solids content) and sprayed into a fluidized bed to provide the finished detergent granules. Prior to the fluidized bed, this process can optionally include the step of mixing the slurry using the aforementioned Lödige CB mixer/densifier or a "Flexomix 160" mixer/densifier, available from Shugi. Fluidized bed or moving beds of the type available under the tradename "Escher Wyss" can be used in such processes.

Another suitable process which can be used herein involves feeding a liquid acid precursor of an anionic surfactant, an alkaline inorganic material (e.g. sodium carbonate) and optionally other detergent ingredients into a high speed mixer/densifier so as to form particles containing a partially or totally neutralized anionic surfactant salt and the other starting detergent ingredients. Optionally, the contents in the high-speed mixer/densifier can be sent to a moderate speed mixer/densifier (e.g. Lödige KM) for further mixing resulting in the finished high-density detergent composition. See Appel et al, U.S. Pat. No. 5,164,108, issued Nov. 17, 1992.

Optionally, high density detergent compositions according to the invention can be produced by blending conventional or densified spray-dried detergent granules with detergent agglomerates in various proportions (e.g. a 60:40 weight ratio of granules to agglomerates) produced by one or a combination of the processes discussed herein. See U.S. Pat. No. 5,569,645, issued Oct. 29, 1996 to Dinniwell et al. Additional adjunct ingredients such as enzymes, perfumes, brighteners and the like can be sprayed or admixed with the agglomerates, granules or mixtures thereof produced by the processes discussed herein.

Related to the detergent composition embodiments are methods of their use, such as a method comprising treating a fabric with the detergent composition of the invention. Such methods are part of the present invention. Machine laundry methods herein typically comprise treating soiled laundry with an aqueous wash solution in a washing machine having dissolved or dispensed therein an effective amount of a machine laundry detergent composition in accord with the invention. By an effective amount of the detergent composition it is here meant from 40 g to 300 g of product dissolved or dispersed in a wash solution of volume from 5 to 65 liters, as are typical product dosages and wash solution volumes commonly employed in conventional machine laundry methods.

As noted, surfactants are used herein in detergent compositions, preferably in combination with other detersive surfactants, at levels which are effective for achieving at least a directional improvement in cleaning performance.

In the context of a fabric laundry composition, such "usage levels" can vary widely, depending not only on the type and severity of the soils and stains, but also on the wash water temperature, the volume of wash water and the type of washing machine.

In a preferred use aspect a dispensing device is employed in the washing method. The dispensing device is charged with the detergent product, and is used to introduce the product directly into the drum of the washing machine before the commencement of the wash cycle. Its volume capacity should be such as to be able to contain sufficient detergent product as would normally be used in the washing method.

Once the washing machine has been loaded with laundry the dispensing device containing the detergent product is placed inside the drum. At the commencement of the wash cycle of the washing machine water is introduced into the drum and the drum periodically rotates. The design of the dispensing device should be such that it permits containment of the dry detergent product but then allows release of this product during the wash cycle in response to its agitation as the drum rotates and also as a result of its contact with the wash water.

Alternatively, the dispensing device may be a flexible container, such as a bag or pouch. The bag may be of fibrous construction coated with a water impermeable protective material so as to retain the contents, such as is disclosed in European published Pat. No. Application No. 0018678. Alternatively it may be formed of a water-insoluble synthetic polymeric material provided with an edge seal or closure designed to rupture in aqueous media as disclosed in European published Patent Application Nos. 0011500, 0011501, 0011502, and 0011968. A convenient form of water frangible closure comprises a water-soluble adhesive disposed along and sealing one edge of a pouch formed of a water impermeable polymeric film such as polyethylene or polypropylene.

Third Embodiment

Precursor Alkylbenzene Mixtures

The present invention also includes an enhanced alkylbenzene mixture comprising (preferably consisting essentially of): (a) from about 60% to about 25%, preferably from about 55% to about 35%, more preferably from about 50% to 40%, by weight of a mixture of enhanced alkylbenzenes having formula (I):

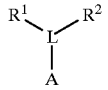

(I)

wherein L is an acyclic aliphatic moiety consisting of carbon and hydrogen and having two methyl termini, and wherein said mixture of enhanced alkylbenzenes contains two or more compounds of said formula (I) differing in molecular weight and wherein said mixture of enhanced alkylbenzenes is characterized by a sum of carbon atoms in $R^1$, $R^2$ and L of from 9 to 15, preferably from 10 to 14; and an average aliphatic carbon content (i.e., excluding A), based on the sum of $R^1$, L and $R^2$, of from about 10.0 to about 14.0, preferably from about 10.5 to about 12.5, more preferably from about 11.0 to about 12.0 carbon atoms; and further, wherein L has no substituents other than A, $R^1$ and $R^2$; $R^1$ is $C_1$–$C_3$ alkyl (preferably $C_1$–$C_2$ alkyl, more preferably methyl); $R^2$ is selected from H and $C_1$–$C_3$ alkyl (preferably H and $C_1$–$C_2$ alkyl, more preferably H and methyl provided that in at least about 0.5, more preferably 0.7, more preferably 0.9 to 1.0 mole fraction of said enhanced alkylbenzenes, $R^2$ is H); A is a (nonsulfonated) benzene moiety ($C_6H_5$— having no substituents other than L); and (b) from about 40% to about 75%, preferably from about 45% to about 65%, more preferably from about 50% to 60%, by weight of a mixture of modified unsubstituted alkylbenzenes having formula (II):

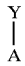

(II)

wherein A is a (nonsulfonated) benzene moiety ($C_6H_5$— having no substituents other than L) and Y is a linear aliphatic moiety with no substituents other than A consisting of carbon and hydrogen having two methyl termini, and wherein Y has from 9 to 15 carbon atoms in total (preferably from 10 to 14) and said mixture of modified unsubstituted alkylbenzenes has an average aliphatic carbon content (i.e., carbon content excluding A) of from about 10.0 to about 14.0 carbon atoms, preferably from about 10.5 to about 12.5 carbon atoms, more preferably from about 11.0 to about 12.0 carbon atoms; and wherein said modified unsubstituted alkylbenzene mixture is further characterized by a 2/3-phenyl index of from about 275 to about 10,000, more preferably from about 300 to about 5,000, more preferably still from about 325 to about 2,500, and a 2-methyl-2-phenyl index of less than about 0.3, preferably from 0 to about 0.2, more preferably no more than about 0.1, more preferably still, 0.05 or less.

In another example, the invention includes an enhanced alkylbenzene mixture comprising: I) from 20% to about 99%, (or more, preferably 40% or more, more preferably more than half, e.g., 60% or more, more preferably still 70% or more), by weight of a first alkylbenzene mixture, wherein said first alkylbenzene mixture is said enhanced alkylbenzene mixture and consists essentially of: a) from about 60% to about 25% by weight of a mixture of enhanced alkylbenzenes having formula (I):

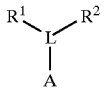

(I)

wherein L is an acyclic aliphatic moiety consisting of carbon and hydrogen and having two methyl termini, and wherein said mixture of enhanced alkylbenzenes contains two or more compounds of said formula (I) differing in molecular weight and wherein said mixture of enhanced alkylbenzenes is characterized by a sum of carbon atoms in $R^1$, R and L of from 9 to 15, preferably from 10 to 14; and an average aliphatic carbon content, based on the sum of $R^1$, L and $R^2$, of from about 10.0 to about 14.0, preferably from about 10.5 to about 12.5, more preferably from about 11.0 to about 12.0 carbon atoms; and further, wherein L has no substituents other than A, $R^1$ and $R^2$; $R^2$ is $C_1$–$C_3$ alkyl (preferably $C_1$–$C_2$ alkyl, more preferably methyl); $R^2$ is selected from H and $C_1$–$C_3$ alkyl (preferably H and $C_1$–$C_2$ alkyl, more preferably H and methyl, more preferably H and methyl provided that in at least about 0.5, more preferably 0.7, more preferably 0.9 to 1.0 mole fraction of said enhanced alkylbenzene sulfonates, $R^2$ is H); A is a (nonsulfonated) benzene moiety ($C_6H_5$— having no substituents other than L); and b) from about 40% to about 75% by weight (preferably from about 45% to about 65%, more preferably from about 50% to about 60%) of a mixture of modified unsubstituted alkylbenzenes having formula (II):

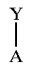

(II)

wherein A is a (nonsulfonated) benzene moiety ($C_6H_5$— having no substituents other than A) and Y is a linear aliphatic moiety having no substituents other than A consisting of carbon and hydrogen having two methyl termini, and wherein Y has from 9 to 15, preferably from 10 to 14 carbon atoms in total and said mixture of modified unsubstituted alkylbenzenes has an average aliphatic carbon content of from about 10.0 to about 14.0, preferably from about 10.5 to about 12.5, more preferably from about 11.0 to about 12.0 carbon atoms; wherein said first alkylbenzene mixture has a 2/3-phenyl index of from about 275 to about 10,000, more preferably from about 300 to about 5,000, more preferably at least about 325 to about 2,500; and II) the balance, no more than about 80%, (preferably no more than about 60%, more preferably less than half, e.g., no more than about 40%, more preferably still no more than about 25%), by weight of a second alkylbenzene mixture, wherein said second alkylbenzene mixture has a 2/3-phenyl index of from about 75 to about 160 (typical of current commercial LAB); and wherein said enhanced alkylbenzene mixture has an overall 2/3-phenyl index of from about 155 to about 10,000 (preferably from about 170 to about 1200, more preferably from about 180 to about 700).

Other Embodiments

Medium 2/3-Phenyl Surfactant Mixtures

The present invention also encompasses enhanced alkylbenzene sulfonate surfactant mixtures that are more particularly termed "medium 2/3-phenyl surfactant mixtures". Such mixtures are not the most preferred offered by the invention, but can be very economical.

Thus the invention includes a medium 2/3-phenyl surfactant mixture consisting essentially of: from 1% (preferably at least about 5%, more preferably at least about 10%) to about 60% (in one mode preferably less than about 50%, more preferably less than about 40%), by weight of a first alkylbenzene sulfonate surfactant, wherein said first alkylbenzene sulfonate surfactant is an enhanced alkylbenzene sulfonate surfactant mixture according to the first embodiment; and from 40% (in one mode preferably at least about 50%, more preferably at least about 60%) to about 99% (preferably less than about 95%, more preferably less than about 90%), by weight of a second alkylbenzene sulfonate surfactant, wherein said second alkylbenzene sulfonate surfactant is an alkylbenzene sulfonate surfactant mixture other than said enhanced alkylbenzene sulfonate surfactant mixture according to the first embodiment, and wherein said second alkylbenzene sulfonate surfactant has a 2/3-phenyl index of from about 75 to about 160 (typically said second alkylbenzene sulfonate surfactant is a commercial $C_{10}$–$C_{14}$ linear alkylbenzene sulfonate surfactant, e.g., DETAL® process LAS or HF process LAS though in general any commercial linear (LAS) or branched (ABS, TPBS) type can be used); provided that said medium 2/3-phenyl surfactant mixture has a 2/3-phenyl index of from about 160 to about 275 (preferably from about 170 to about 265, more preferably from about 180 to about 255). (of course it is equally possible within the spirit and scope of the invention to prepare any blend of the enhanced alkylbenzene sulfonate surfactant mixture of the invention with any known commercial linear or branched alkylbenzene sulfonate surfactant.

Also included is a detergent composition comprising (preferably consisting essentially of): (a) from about 0.1% to about 95%, by weight (preferably from about 0.5% to about 50%, more preferably from about 1% to about 35%) of medium 2/3-phenyl surfactant mixture as defined supra; (b) from about 0.00001% to about 99.9% (preferably from about 5% to about 98%, more preferably from about 50% to about 95%) of conventional cleaning adjuncts other than surfactants; and (c) from 0% to about 50%, by weight (in some preferred embodiments, 0%, and in others preferably from about 0.1% to about 30%, more typically from about 0.2% to about 10%), of a surfactant other than said medium 2/3-phenyl surfactant mixture; provided that when said detergent composition comprises any other alkylbenzene sulfonate than the alkylbenzene sulfonate of said medium 2/3-phenyl surfactant mixture, said medium 2/3-phenyl surfactant mixture and said other alkylbenzene sulfonate, as a mixture, have an overall 2/3-phenyl index of from about 160 to about 275 (preferably from about 170 to about 265, more preferably from about 180 to about 255).

Likewise part of the invention is a detergent composition comprising: (a) from about 0.1% to about 95%, by weight of medium 2/3-phenyl surfactant mixture as defined supra; (b) from about 0.00001% to about 99.9% of conventional cleaning adjuncts other than surfactants; and (c) from 0.1% to about 50%, by weight of surfactants other than alkylbenzene sulfonates (preferably, one or more surfactants selected from the group consisting of cationic surfactants, anionic surfactants, and anionic surfactants other than alkylbenzene sulfonates, more preferably wherein a cationic surfactant is present at a level of from about 0.2% to about 5%).

Moreover there is included herein a detergent composition consisting essentially of: (a) from about 1% to about 50%, by weight of medium 2/3-phenyl surfactant mixture as defined supra; (b) from about 0.1% to about 98.8% of conventional cleaning adjuncts other than surfactants; (c) from 0.1% to about 50%, by weight of surfactants other than alkylbenzene sulfonates (preferably, one or more surfactants selected from the group consisting of cationic surfactants, anionic surfactants, and anionic surfactants other than alkylbenzene sulfonates, more preferably wherein a cationic surfactant is present at a level of from about 0.2% to about 5%); and (d) from about 0.1% to about 98.8% water.

In additional embodiments of the medium 2/3-phenyl type, there is included a detergent composition consisting essentially of: (a) from about 0.1% to about 95%, preferably from 1% to about 50% by weight of medium 2/3-phenyl surfactant mixture as defined supra; and (b) from about 0.00001% to about 99.9% of conventional cleaning adjuncts other than surfactants.

Processes for preparing a medium 2/3-phenyl surfactant mixture include those comprising a step selected from: (i) blending said first alkylbenzene sulfonate surfactant and said second alkylbenzene sulfonate surfactant; and (ii) blending the nonsulfonated precursor of said first alkylbenzene sulfonate surfactant and the nonsulfonated precursor of said second alkylbenzene sulfonate surfactant and sulfonating said blend.

PREPARATIVE EXAMPLES

Example 1

Mixture of 4-methyl-4-nonanol, 5-methyl-5-decanol, 6-methyl-6-undecanol and 6-methyl-6-dodecanol

A Starting-material for Methyl-substituted Olefins

A mixture of 4.01 g of 2-pentanone, 32.70 g of 2-hexanone, 45.41 g of 2-heptanone, 17.88 g of 2-octanone and 72.6 g of diethyl ether is added to an addition funnel. The ketone mixture is then added dropwise over a period of 2.25 hours to a nitrogen blanketed stirred three neck 2 L round bottom flask, fitted with a reflux condenser and containing 612 mL of 2.0 M n-pentylmagnesium bromide in diethyl ether and an additional 400 mL of diethyl ether. After the addition is complete the reaction mixture is stirred an additional 2.5 hours at 20° C. The reaction mixture is then added to lkg of cracked ice with stirring. To this mixture is added 401.2 g of 30% sulphuric acid solution. The aqueous acid layer is drained and the remaining ether layer is washed twice with 750 mL of water. The ether layer is then evaporated under vacuum to yield 179.6 g of a mixture of 4-methyl-4-nonanol, 5-methyl-5-decanol, 6-methyl-6-undecanol and 6-methyl-6-dodecanol.

Example 2

Substantially Methyl-substituted Olefin Mixture with Randomised Branching

A Methyl-substituted Olefin Mixture, which is an Alkylating Agent for Preparing Enhanced Alkylbenzenes in Accordance with the Invention a) A 179.6 g sample of the mono methyl branched alcohol mixture of Example 1 is added to a nitrogen blanketed stirred three neck round bottom 500 mL flask, fitted with a Dean Stark trap and a reflux condenser along with 36.5 g of a shape selective zeolite catalyst (acidic mordenite catalyst Zeocat™ FM-8/25H). With mixing, the mixture is then heated to about 110–155° C. and water and some olefin is collected over a period of 4–5 hours in the Dean Stark trap. The conversion of the alcohol mixture of Example 1 to a substantially non-randomized methyl branched olefin mixture is now complete. The substantially non-randomized methyl branched olefin mixture remaining in the flask along with the substantially non-randomized methyl branched olefin mixture collected in the dean stark trap is recombined and filtered to remove catalyst. The solid filter cake is washed twice with 100 mL portions of hexane. The hexane filtrate is evaporated under vacuum and the resulting product is combined with the first filtrate to give 151.2 g of a substantially non-randomized methyl branched olefin mixture.

b) The olefin mixture of Example 2a is combined with 36 g of a shape selective zeolite catalyst (acidic mordenite catalyst Zeocat™ FM-8/25H) and reacted according to Example 2a with the following changes. The reaction temperature is raised to 190–200° C. for a period of about 1–2 hours to randomize the specific branch positions in the olefin mixture. The substantially mono methyl branched olefin mixture with randomized branching remaining in the flask along with the substantially mono methyl branched olefin mixture with randomized branching collected in the dean stark trap are recombined and filtered to remove catalyst. The solid filter cake is washed twice with 100 mL portions of hexane. The hexane filtrate is evaporated under vacuum and the resulting product is combined with the first filtrate to give 150.0 g of a substantially mono methyl branched olefin mixture with randomized branching.

Example 3

Enhanced Alkylbenzenes with a 2/3-Phenyl Index of About 550 and a 2-Methyl-2-Phenyl Index of About 0.02

An Enhanced Alkylbenzenes in Accordance with the Invention 150.0 g of the substantially mono methyl branched olefin mixture of Example 2 and 36 g of a shape selective zeolite catalyst (acidic mordenite catalyst Zeocat™ FM-8/25H) are added to a 2-gallon stainless steel, stirred autoclave. Residual olefin and catalyst in the container are washed into the autoclave with 300 mL of n-hexane and the autoclave is sealed. From outside the autoclave cell, 2000 g of benzene (contained in a isolated vessel and added by way of an isolated pumping system inside the isolated autoclave cell) is added to the autoclave. The autoclave is purged twice with 250 psig $N_2$, and then charged to 60 psig $N_2$. The mixture is stirred and heated to about 200° C. for about 4–5 hours. The autoclave is cooled to about 20° C. overnight. The valve is opened leading from the autoclave to the benzene condenser and collection tank. The autoclave is heated to about 120° C. with continuous collection of benzene. No more benzene is collected by the time the reactor reaches 120° C. The reactor is then cooled to 40° C. and 750 g of n-hexane is pumped into the autoclave with mixing. The autoclave is then drained to remove the reaction mixture. The reaction mixture is filtered to remove catalyst and the n-hexane is removed under vacuum. The product is distilled under vacuum (1–5 mm of Hg). The enhanced alkylbenzenes with a 2/3-Phenyl index of about 550 and a 2-methyl-2-phenyl index of about 0.02 is collected from 76° C.-130° C. (170 g).

Example 4

Enhanced Alkylbenzene Sulfonic Acids with a 2/3-Phenyl Index of About 550 and a 2-Methyl-2-Phenyl Index of About 0.02

An Enhanced Alkylbenzene Sulfonic Acids in Accordance with the Invention

The product of Example 3 is sulfonated with a molar equivalent of chlorosulfonic acid using methylene chloride as solvent. The methylene chloride is removed to give 214 g of an enhanced alkylbenzene sulfonic acids with a 2/3-Phenyl index of about 550 and a 2-methyl-2-phenyl index of about 0.02

Example 5

Enhanced Alkylbenzene Sulfonate, Sodium Salts with a 2/3-Phenyl Index of About 550

An Enhanced Alkylbenzene Sulfonate Surfactants in Accordance with the Invention The product of Example 4 is neutralized with a molar equivalent of sodium methoxide in methanol and the methanol is evaporated to give 229 g of an enhanced alkylbenzene sulfonate, sodium salts with a 2/3-Phenyl index of about 550 and a 2-methyl-2-phenyl index of about 0.02.

Example 6

Enhanced Alkylbenzene Mixture According to the Invention with a 2/3-Phenyl Index of About 550 and a 2-Methyl-2-Phenyl Index of About 0.02

Enhanced and Modified Unsubstituted Alkylbenzene Mixture 66.15 g of the substantially mono methyl branched olefin mixture of Example 2, 80.85 g a nonbranched olefin mixture (decene:undecene:dodecene:tridecene ratio of 17:38:35:10) and 36 g of a shape selective zeolite catalyst (acidic mordenite catalyst Zeocat™ FM-8/25H) are added to a 2-gallon stainless steel, stirred autoclave. Residual olefin and catalyst in the container are washed into the autoclave with 300 mL of n-hexane and the autoclave is sealed. From outside the autoclave cell, 2000 g of benzene (contained in a isolated vessel and added by way of an isolated pumping system inside the isolated autoclave cell) is added to the autoclave. The autoclave is purged twice with 250 psig $N_2$, and then charged to 60 psig $N_2$. The mixture is stirred and heated to about 200° C. for about 4–5 hours. The autoclave is cooled to about 20° C. overnight. The valve is opened leading from the autoclave to the benzene condenser and collection tank. The autoclave is heated to about 120° C. with continuous collection of benzene. No more benzene is collected by the time the reactor reaches 120° C. The reactor is then cooled to 40° C. and 750 g of n-hexane is pumped into the autoclave with mixing. The autoclave is then drained to remove the reaction mixture. The reaction mixture is filtered to remove catalyst and the n-hexane is removed under vacuum. The product is distilled under vacuum (1–5 mm of Hg). An enhanced alkylbenzene mixture with a 2/3-Phenyl index of about 550 and a 2-methyl-2-phenyl index of about 0.02 is collected from 76° C.-130° C. (167 g).

Example 7

Enhanced Alkylbenzene Sulfonic Acid Mixture According to the Invention with a 2/3-Phenyl Index of about 550 and a 2-Methyl-2-Phenyl Index of About 0.02

Enhanced and Modified Unsubstituted Alkylbenzene Sulfonic Acid Mixture 100 g of the product of Example 6 is sulfonated with a molar equivalent of chlorosulfonic acid using methylene chloride as solvent. The methylene chloride is removed to give 135.8 g of an enhanced alkylbenzene sulfonic acid mixture with a 2/3-Phenyl index of about 550 and a 2-methyl-2-phenyl index of about 0.02.

Example 8

Enhanced Alkylbenzene Sulfonate, Sodium Salt Mixture According to the Invention with a 2/3-Phenyl Index of About 550 and a 2-Methyl-2-Phenyl Index of About 0.02

Enhanced and Modified Unsubstituted Alkylbenzene Sulfonate, Sodium Salt Mixture

The enhanced sulfonic acid mixture of Example 7 is neutralized with a molar equivalent of sodium methoxide in methanol and the methanol is evaporated to give 225 g of an enhanced alkylbenzene sulfonate, sodium salt mixture with a 2/3-Phenyl index of about 550 and a 2-methyl-2-phenyl index of about 0.02.

Example 9

Enhanced Alkylbenzene Sulfonate Surfactant Mixtures According to the Invention

Medium 2/3-Phenyl Type

Blends are prepared of:

I) Enhanced alkylbenzene sulfonate surfactant mixture in accordance with the invention having a 2/3-Phenyl index of about 550 (according to Example 8)

II) Commercial $C_{11.7}$ (average) linear alkylbenzene sulfonate surfactant (HF type) sodium salt having a 2/3-Phenyl index of about 100

In the table below, percentages are by weight:

| | A | B | C |
|---|---|---|---|
| I | 25% | 15% | 38% |
| II | 75% | 85% | 62% |

Each of the above blends has a 2/3-phenyl index in the range from about 160 to about 275.

Example 10

Enhanced Alkylbenzene Sulfonate Surfactant Mixtures According to the Invention

Medium 2/3-phenyl Type

Blends are prepared of:

I) Enhanced alkylbenzene sulfonate surfactant mixture in accordance with the invention having a 2/3-Phenyl index of about 550 (according to Example 8)

II) Commercial $C_{11.7}$ (average) linear alkylbenzene sulfonate surfactant (DETAL® type) sodium salt having a 2/3-Phenyl index of about 150

In the table below, percentages are by weight:

| | A | B | C |
|---|---|---|---|
| I | 25% | 15% | 10% |
| II | 75% | 85% | 90% |

Each of the above blends has a 2/3-phenyl index in the range from about 160 to about 275.

Example 11

Enhanced Alkylbenzene Sulfonic Acid Mixtures According to the Invention

Medium 2/3-phenyl Type

Blends are prepared of:

I) Enhanced alkylbenzene sulfonic acid surfactant mixture in accordance with the invention having a 2/3-Phenyl index of about 550 (according to Example 7)

II) Commercial $C_{11.7}$ (average) linear alkylbenzene sulfonic acid (HF type) having a 2/3-Phenyl index of about 100.

In the table below, percentages are by weight:

| | A | B | C |
|---|---|---|---|
| I | 25% | 15% | 38% |
| II | 75% | 85% | 62% |

Each of the above blends has a 2/3-phenyl index in the range from about 160 to about 275.

Example 12

Enhanced Alkylbenzene Sulfonic Acid Mixtures According to the Invention

Medium 2/3-phenyl Type

Blends are prepared of:

I) Enhanced alkylbenzene sulfonic acid mixture in accordance with the invention having a 2/3-Phenyl index of about 550 (according to Example 4)

II) Commercial $C_{11.7}$ (average) linear alkylbenzene sulfonic acid (DETAL® type) having a 2/3-Phenyl index of about 150.

In the table below, percentages are by weight:

| | A | B | C |
|---|---|---|---|
| I | 25% | 15% | 10% |
| II | 75% | 85% | 90% |

Each of the above blends has a 2/3-phenyl index in the range from about 160 to about 275.

Example 13

Enhanced Alkylbenzene Mixtures According to the Invention

Medium 2/3-phenyl Type

Blends are prepared of:

I) Enhanced alkylbenzene mixture in accordance with the invention having a 2/3-Phenyl index of about 550 (according to Example 6)

II) Commercial $C_{11.7}$ (average) linear alkylbenzene (HF type) having a 2/3-Phenyl index of about 100.

In the table below, percentages are by weight:

| | A | B | C |
|---|---|---|---|
| I | 25% | 15% | 38% |
| II | 75% | 85% | 62% |

Each of the above blends has a 2/3-phenyl index in the range from about 160 to about 275.

Example 14

Enhanced Alkylbenzene Mixtures According to the Invention

Medium 2/3-phenyl Type

Blends are prepared of:

I) enhanced alkylbenzene sulfonate surfactant mixture in accordance with the invention having a 2/3-Phenyl index of about 550 (according to Example 3)

II) Commercial $C_{11.7}$ (average) linear alkylbenzene (DETAL® type) having a 2/3-Phenyl index of about 150.

In the table below, percentages are by weight:

| | A | B | C |
|---|---|---|---|
| I | 25% | 15% | 10% |
| II | 75% | 85% | 90% |

Each of the above blends has a 2/3-phenyl index in the range from about 160 to about 275.

Example 15

Enhanced Alkylbenzene Mixture According to the Invention with a 2/3-Phenyl Index of About 550 and a 2-Methyl-2-Phenyl Index of About 0.02

Enhanced and Modified Unsubstituted Alkylbenzene Mixture 150 g of an olefin or paraffin mixture with chain length of $C_{10}$–$C_{13}$, which is obtained via any one of the following:

1) Dehydrogenation of a paraffin mixture obtained from kerosene feed stock via a molecular sieving unit designed to isolate a mixture, consisting mainly of both linear and monomethyl branched paraffins from cyclic and dimethyl branched paraffins with a chain length Of $C_{10}$–$C_{13}$, is blended, if needed, to achieve a linear content of 40% to 75% and is converted to an alkylbenzene mixture According to Example 3.

Example 16

Enhanced Alkylbenzene Sulfonic Acid Mixture According to the Invention with a 2/3-Phenyl Index of About 550 and a 2-Methyl-2-Phenyl Index of About 0.02

Enhanced and Modified Unsubstituted Alkylbenzene Sulfonic Acid Mixture 10 g of the product of Example 15 is sulfonated with a molar equivalent of chlorosulfonic acid using methylene chloride as solvent. The methylene chloride is removed to give 13.58 g of an enhanced alkylbenzene sulfonic acid mixture with a 213-Phenyl index of about 550 and a 2-methyl-2-phenyl index of about 0.02.

Example 17

Enhanced Alkylbenzene Sulfonate, Sodium Salt Mixture According to the Invention with a 2/3-Phenyl Index of About 550 and a 2-Methyl-2-Phenyl Index of About 0.02

Enhanced and Modified Unsubstituted Alkylbenzene Sulfonate, Sodium Salt Mixture The product of Example 16 is converted to it's sodium salt using the procedure of Example 5.

Example 18

Enhanced Alkylbenzene Sulfonate, Sodium Salt Mixture According to the Invention with a 2/3-Phenyl Index of About 550 and a 2-Methyl-2-Phenyl Index of About 0.02

Enhanced and Modified Unsubstituted Alkylbenzene Mixture 150 g of an olefin mixture with chain length of C10–C13, which is obtained via any one of the following:

5) Dimerization of short chain olefin mixtures inside a molecular sieve
6) Oligomerization of short chain olefin mixtures inside a molecular sieve
7) Product of cracking long-chain hydrocarbon waxes under conditions to obtain a mainly mono methyl branched olefin product;
8) Dehydrogenation of a paraffin mixture obtained from a gas to liquids (GTL) plant.

Is blended with linear olefins to provide a linear to branch ratio of about 50:50 then converted to an alkylbenzene mixture According to Example 3, an alkylbenzene sulfonic acid according to the Example 4 and finally converted to a salt of the acid according to Example 5.

Example 19

Enhanced Alkylbenzene Sulfonate, Sodium Salt Mixture according to the invention via blending of (I) mono-methyl substituted olefin mixture and (II) linear olefin mixture as defined in the table below.

| Mixture | Blend 1 | Blend 2 | Blend 3 | Blend 4 |
|---|---|---|---|---|
| I | 25% | 35% | 45% | 60% |
| II | 75% | 65% | 55% | 40% |

Each of the four blends above are alkylated according to Example 3, sulfonated according to Example 4, and neutralized according to Example 5.

Methods for Determining Compositional Parameters (2/3-phenyl Index, 2-methyl-2-phenyl Index) of Mixed Alkylbenzene/Alkylbenzene Sulfonate/Alkylbenzene Sulfonic Acid Systems It is well known in the art to determine compositional parameters of conventional linear alkylbenzenes and/or highly branched alkylbenzene sulfonates (TPBS, ABS). See, for Example Surfactant Science Series, Volume 40, Chapter 7 and Surfactant Science Series, Volume 73, Chapter 7. Typically, this is done by GC and/or GC-mass spectroscopy for the alkylbenzenes and HPLC for the alkylbenzene sulfonates or sulfonic acids; $^{13}C$ nmr is also commonly used. Another common practice is desulfonation. This permits GC and/or GC-mass spectroscopy to be used, since desulfonation converts the sulfonates or sulfonic acids to the alkylbenzenes that are tractable by such methods.

In general, the present invention provides unique and relatively complex mixtures of enhanced alkylbenzenes, and similarly complex surfactant mixtures of enhanced alkylbenzene sulfonates and/or alkylbenzene sulfonic acids. Compositional parameters of such compositions can be determined using variations and combinations of the art-known methods.

The sequence of methods to be used depends on the composition to be characterized as follows:

| Composition to be characterized | Sequence of Methods (Methods separated by commas are run in sequence, others can be run in parallel) |
|---|---|
| Alkylbenzene mixtures | GC, NMR1 NMR 2 |
| Alkylbenzene mixtures with impurities* | GC, DIS, GC, NMR1 NMR 2 |

-continued

| Composition to be characterized | Sequence of Methods (Methods separated by commas are run in sequence, others can be run in parallel) |
|---|---|
| Alkylbenzene sulfonic acid mixtures | Option 1: HPLC, NMR3 NMR 4<br>Option 2: HPLC, DE, NMR1 NMR 2 |
| Alkylbenzene sulfonate salt mixtures | Option 1: HPLC, AC, NMR3 NMR 4<br>Option 2: HPLC, DE, NMR1 NMR 2 |
| Alkylbenzene sulfonic acid mixtures with impurities* | Option 1: HPLC, HPLC-P, HPLC, NMR3 NMR 4<br>Option 2: HPLC, DE, DIS, GC, NMR1 NMR 2 |
| Alkylbenzene sulfonate salt mixtures with impurities* | Option 1: HPLC, HPLC-P, HPLC, AC, NMR3 NMR 4<br>Option 2: HPLC, DE, DIS, GC, NMR1 NMR 2 |

* Typically preferred when the material contains more than about 10% impurities such as dialkylbenzenes, olefins, paraffins, hydrotropes, dialkylbenzene sulfonates, etc.

GC

Equipment

Hewlett Packard Gas Chromatograph HP5890 Series II equipped with a split/splitless injector and FID J&W Scientific capillary column DB-1HT, 30 meter, 0.25 mm id, 0.1 um film thickness cat# 1221131

Restek Red lite Septa 11 mm cat# 22306

Restek 4 mm Gooseneck inlet sleeve with a carbofrit cat# 20799-209.5

O-ring for inlet liner Hewlett Packard cat# 5180-4182

J. T. Baker HPLC grade Methylene Chloride cat# 9315-33, or equivalent 2 ml GC autosampler vials with crimp tops, or equivalent Sample Preparation Weigh 4–5 mg of sample into a 2 ml GC autosampler vial Add 1 ml J. T. Baker HPLC grade Methylene Chloride, cat# 9315-33 to the GC vial, seal with 11 mm crimp vial teflon lined closures (caps), part # HP5181-1210 using crimper tool, part # HP8710-0979 and mix well The sample is now ready for injection into the GC GC Parameters Carrier Gas: Hydrogen
- Column Head Pressure: 9 psi
- Flows:
  - Column Flow @ 1 ml/min.
  - Split Vent @ ~3 ml/min.
  - Septum Purge @ 1 ml/min.
- Injection: HP 7673 Autosampler, 10 ul syringe, 1 ul injection
- Injector Temperature: 350° C.
- Detector Temperature: 400° C.

Oven Temperature Program:
- initial 70° C. hold 1 min.
- rate 1° C./min.
- final 180° C. hold 10 min.

Standards required for this method are 2-phenyloctane and 2-phenylpentadecane, each freshly distilled to a purity of greater than 98%. Run both standards using the conditions specified above to define the retention time for each standard. This defines a retention time range which is the retention time range to be used for characterizing any alkylbenzenes or alkylbenzene mixtures in the context of this invention (e.g., test samples). Now run the test samples for which compositional parameters are to be determined. Test samples pass the GC test provided that greater than 90% of the total GC area percent is within the retention time range defined by the two standards. Test samples that pass the GC test can be used directly in the $NMR^1$ and $NMR^2$ test methods. Test samples that do not pass the GC test must be further purified by distillation until the test sample passes the GC test.

Desulfonation (DE)

The desulfonation method is a standard method described in "The Analysis of Detergents and Detergent Products" by G. F. Longman on pages 197–199. Two other useful descriptions of this standard method are given on page 230–231 of volume 40 of the Surfactant Sience Series edited by T. M. Schmitt: "Analysis of Surfactants" and on page 272 of volume 73 of the Surfactant Science Series: "Anionic Surfactants" edited by John Cross. This is an alternative method to the HPLC method, described herein, for evaluation of alkylbenzene sulfonic acid and/or salt mixtures (alkylbenzene sulfonic acid and/or salt mixtures, including those of the claimed invention). The method provides a means of converting the sulfonic acid and/or salt mixture into alkylbenzene mixtures which can then be analyzed by means of the GC and NMR methods $NMR^1$ and $NMR^2$ described herein.

HPLC

See L. R. Snyder and J. J. Kirkland, "Introduction to Modern Liquid Chromatography", 2nd. Ed., Wiley, N.Y., 1979.

| Apparatus | |
|---|---|
| Suitable HPLC System | Waters Division of Millipore or equivalent. |
| HPLC pump with He sparge and temperature control | Waters, model 600 or equivalent |
| Autosampler/injector | Waters 717, or equivalent |
| Autosampler 48 position tray | Waters or equivalent |
| UV detector | Waters PDA 996 or equivalent |
| Fluorescence detector | Waters 740 or equivalent |
| Data System/Integrator | Waters 860 or equivalent |
| Autosampler vials and caps | 4 mL capacity, Millipore #78514 and #78515. |
| HPLC Column, X2 | Supelcosil LC18, 5 μm, 4.6 mm × 25 cm, Supelcosil #58298 |
| Column Inlet Filter | Rheodyne 0.5 μm × 3 mm Rheodyne #7335 |
| LC eluent membrane filters | Millipore SJHV M47 10, disposable filter funnel with 0.45-μm membrane. |
| Balance | Sartorius or equivalent; precision ±0.0001 g. |
| Vacuum | Sample Clarification Kit with pumps and filters, Waters #WAT085113. |
| **Reagents** | |
| C8 LAS standard material | Sodium-p-2-octylbenzene sulfonate. |
| C15 LAS standard material | Sodium-p-2-pentadecylbenzene sulfonate. |

Procedure

A. Preparation of HPLC Mobile Phase

1. Mobile Phase A
   a) Weigh 11.690 g sodium chloride and transfer to a 2000 mL volumetric flask. Dissolve in 200 mL HPLC grade water.
   b) Add 800 mL of acetonitrile and mix. Dilute to volume after solution comes to room temperature. This prepares a solution of 100 mM NaC1/40% ACN.
   c) Filter through an LC eluent membrane filter and degas prior to use.
2. Mobile phase B—Prepare 2000 mL of 60% acetonitrile in HPLC grade water. Filter through an LC eluent membrane filter and degas prior to use.

B. C8 and C15 Internal Standard Solution

1. Weigh 0.050 g of a 2-phenyloctylbenzenesulfonate and 0.050 g of 2-Phenylpentadecanesulfonate standards and quantitatively transfer to a 100 mL volumetric flask.
2. Dissolve with 30 mL ACN and dilute to volume with HPLC grade water. This prepares ca. 1500-ppm solution of the mixed standard.

C. Sample Solutions

1. Wash Solutions—Transfer 250 μL of the standard solution to a 1 mL autosampler vial and add 750 μL of the wash solution. Cap and place in the autosampler tray.
2. Alkylbenzene sulfonic acid or Alkylbenzene sulfonate—Weigh 0.10 g of the alkylbenzene sulfonic acid or salt and quantitatively transfer to a 100 mL volumetric flask. Dissolve with 30 mL ACN and dilute to volume with HPLC grade water. Transfer 250 μL of the standard solution to a 1 mL autosampler vial and add 750 μL of the sample solution. Cap and place in the autosampler tray. If solution is excessively turbid, filter through 0.45 μm membrane before transferring to autosampler vial. Cap and place in the auto-sampler tray.

D. HPLC System

1. Prime HPLC pump with mobile phase. Install column and column inlet filter and equilibrate with eluent (0.3 mL/min for at least 1 hr.).
2. Run samples using the following HPLC conditions:

| | | |
|---|---|---|
| Mobile phase A | 100 mM NaCl/40% ACN | |
| Mobile phase B | 40% $H_2O$/60% ACN | |
| time 0 min. | 100% Mobile phase A | 0% Mobile Phase B |
| time 75 min. | 5% Mobile phase A | 95% Mobile Phase B |
| time 98 min. | 5% Mobile phase A | 95% Mobile Phase B |
| time 110 min. | 100% Mobile phase A | 0% Mobile Phase B |
| time 120 min. | 100% Mobile phase A | 0% Mobile Phase B |

Note: A gradient delay time of 5–10 minutes may be needed depending on dead volume of HPLC system.

| | |
|---|---|
| Flow rate | 1.2 mL/min. |
| Temperature | 25° C. |
| He sparge rate | 50 mL/hr. |
| UV detector | 225 nm |
| Fluorescence detector | λ = 225 nm, λ = 295 nm with sensitivity at 10 x. |
| Run time | 120 min. |
| Injection volume | 10 μL |
| Replicate injections | 2 |
| Data rate | 0.45 MB/Hr. |
| Resolution | 4.8 nm |

3. The column should be washed with 100% water followed by 100% acetonitrile and stored in 80/20 ACN/water.

The HPLC elution time of the 2-phenyloctylbenzenesulfonate defines the lower limit and the elution time of the 2-phenylpentadecanesulfonate standard defines the upper limit of the HPLC analysis relating to the alkylbenzene sulfonic acid/salt mixture of the invention. If 90% of the alkylbenzene sulfonic acid/salt mixture components have retention times within the range of the above standards then the sample can be further defined by methods NMR 3 and NMR 4.

If the alkylbenzene sulfonic acid/salt mixture contains 10% or more of components outside the retention limits defined by the standards then the mixture should be further purified by method HPLC-P or by DE, DIS methods.

HPLC Preparative (HPLC-P)

Alkylbenzene sulfonic acids and/or the salts which contain substantial impurities (10% or greater) are purified by preparative HPLC. See L. R. Snyder and J. J. Kirkland, "Introduction to Modern Liquid Chromatography", 2nd. Ed., Wiley, N.Y., 1979. This is routine to one skilled in the art. A sufficient quantity should be purified to meet the requirements of the NMR 3 and NMR 4.

Preparative LC Method Using Mega Bond Elut Sep Pak® (HPLC-P)

Alkylbenzene sulfonic acids and/or the salts which contain substantial impurities (10% or greater) can also be purified by an LC method (also defined herein as HPLC-P).

This procedure is actually preferred over HPLC column prep purification. As much as 500 mg of unpurified alkylbenzene sulfonic salt can be loaded onto a 10 g (60 ml) Mega Bond Elut Sep Pak® and with optimized chromatography the purified salt can be isolated and ready for freeze drying within 2 hours. A 100 mg sample of alkylbenzene sulfonate salt can be loaded onto a 5 g (20 ml) Bond Elut Sep Pak and ready within the same amount of time.

A. Instrumentation

HPLC: Waters Model 600E gradient pump, Model 717 Autosampler, Water's Millennium PDA, Millennium Data Manager (v. 2.15)

Mega Bond Elut: C18 bonded phase, Varian 5 g or 10 g, PN:1225-6023, 1225-6031 with adaptors HPLC Columns: Supelcosil LC-18 (×2), 250×4.6 mm, 5 mm; #58298

Analytical Balance: Mettler Model AE240, capable of weighing samples to ±0.01 mg B. Accessories Volumetrics: glass, 10 mL Graduated Cylinder: 1 L HPLC Autosampler Vials: 4 mL glass vials with Teflon caps and glass low volume inserts and pipette capable of accurately delivering 1, 2, and 5 mL volumes C. Reagents and Chemicals Water (DI-$H_2O$): Distilled, deionized water from a Millipore, Milli-Q system or equivalent Acetonitrile ($CH_3CN$): HPLC grade from Baker or equivalent Sodium Chloride Crystal Baker Analyzed or equivalent D. BPLC Conditions Aqueous Phase Preparation:

A: To 600 mL of DI-$H_2O$ contained in a 1 L-graduated cylinder, add 5.845 of sodium chloride. Mix well and add 400 ml ACN. Mix well.

B: To 400 ml of DI-H2O contained in a 1 L graduated cylinder, add 600 ml ACN and mix well.

Reservoir A: 60/40, $H_2O$/CAN with salt and Reservoir B: 40/60, $H_2O$/ACN

Run Conditions: Gradient: 100% A for 75 min. 5%A/95% B for 98 min. 5%A/95% B for 110 min. 100%A for 125 min.

| Column Temperature | Not Thermo-statted (i.e., room temp.) |
|---|---|
| HPLC Flow Rate | 1.2 mL/min |
| Injection Volume | 10 mL |
| Run Time | 125 minutes |
| UV Detection | 225 nm |
| Cone. | >4 mg/ml |

Sep Pak Equilibration (Bond Elut, 5 G)

1. Pass 10 ml of a solution containing 25/75 $H_2O$/ACN onto the sep pak by applying positive pressure with a 10 cc syringe at a rate of ~40 drops/min. Do not allow the sep pak to go dry.
2. Immediately pass 10 ml (×3) of a solution containing 70/30 $H_2O$/ACN in the same manner as #1. Do not allow the sep pak to go dry. Maintain a level of solution (~1 mm) at the head of the sep pak.
3. The sep pak is now ready for sample loading.

Sample Loading/Separation and Isolation

4. Weigh <200 mg of sample into a 1 dram vial and add 2 ml of 70/30 $H_2O$/ACN. Sonicate and mix well.
5. Load sample onto Bond Elut and with positive pressure from a 10 cc syringe begin separation. Rinse vial with 1 ml (×2) portions of the 70/30 solution and load onto sep pak. Maintain ~1 mm of solution at the head of the sep pak.
6. Pass 10 ml of 70/30 onto the Bond Elut with positive pressure from a 10 cc syringe at a rate of ~40 drops/min.
7. 4. Repeat this with 3 ml and 4 ml and collect effluent if interested in impurities.

Isolation and Collection

1. Pass 10 ml of solution containing 25/75 $H_2O$/ACN with positive pressure from a 10 cc syringe and collect effluent. Repeat this with another 10 ml and again with 5 ml. The purified alkylbenzene sulfonic acid salt is now ready for freeze drying and subsequent characterization.
2. Rotovap until ACN is removed and freeze dry the remaining $H_2O$. Sample is now ready for chromatography.

Note: When incorporating the Mega Bond Elut Sep Pak (10 g version) up to 500 mg of sample can be loaded onto the sep pak and with solution volume adjustments, the effluent can be ready for freeze drying within 2 hours.

Sep Pak Equilibration (Bond Elut, 10 G)

1. Pass 20 ml of a solution containing 25/75 $H_2O$/ACN onto the sep pak using laboratory air or regulated cylinder air at a rate which will allow ~40 drops/min. You cannot use positive pressure from a syringe because it is not sufficient to move the solution thru the sep pak. Do not allow the sep pak to go dry.
2. Immediately pass 20 ml (×2) and an additional 10 ml of a solution containing 70/30 $H_2O$/ACN in the same manner as #1. Do not allow the sep pak to go dry. Maintain a level of solution (~1 mm) at the head of the sep pak.
3. The sep pak is now ready for sample loading.

Sample Loading/Separation and Isolation

1. Weigh <500 mg of sample into a 2 dram vial and add 5 ml of 70/30 $H_2O$/ACN. Sonicate and mix well.
2. Load sample onto Bond Elut and with positive pressure from an air source begin separation. Rinse vial with 2 ml (×2) portions of the 70/30 solution and put onto the sep pak. Maintain ~1 mm of solution at the head of the sep pak.
3. Pass 20 ml of 70/30 onto the Bond Elut with positive pressure from an air source at a rate of ~40 drops/min. Repeat this with 6 ml and 8 ml and collect effluent if interested in impurities.

Isolation and Collection

1. Pass 20 ml of solution containing 25/75 $H_2O$/ACN with positive pressure from an air source and collect effluent.
2. Repeat this with another 20 ml and again with 10 ml. This isolated fraction contains the pure MLAS.
3. The isolated alkylbenzene sulfonic acid salt is now ready for freeze drying and subsequent characterization.
4. Rotovap until ACN is removed and freeze dry the remaining $H_2O$. Sample is now ready for chromatography.

Note: Adjustments in organic modifier concentration may be necessary for optimum separation and isolation.

Distillation (DIS)

A 5-liter, 3-necked round bottom flask with 24/40 joints is equipped with a magnetic stir bar. A few boiling chips (Hengar Granules, catalog #136-C) are added to the flask. A 9½-inch long vigreux condenser with a 24/40 joint is placed in the center neck of the flask. A water-cooled condenser is attached to the top of the vigreux condenser which is fitted with a calibrated thermometer. A vacuum-receiving flask is attached to the end of the condenser. A glass stopper is placed in one side arm of the 5-liter flask and a calibrated thermometer in the other. The flask and the vigreux condenser are wrapped with aluminum foil. To the 5-liter flask, is added 2270 g of an alkylbenzene mixture which contains 10% or more impurities as defined by the GC method. A vacuum line leading from a vacuum pump is attached to the receiving flask. The alkylbenzene mixture in the 5-liter flask is stirred and vacuum is applied to the system. Once the maximum vacuum is reached (at least 1 inch of Hg pressure by gauge or less), the alkylbenzene mixture is heated by means of an electric heating mantle. The distillate is collected in two fractions. Fraction A is collected from about 25° C. to about 90° C. as measured by the calibrated thermometer at the top of the vigreux column. Fraction B is collected from about 90° C. to about 155° C. as measured by the calibrated thermometer at the top of the vigreux column. Fraction A and pot residues (high boiling) are discarded. Fraction B (1881 g) contains the alkylbenzene mixture of interest. The method can be scaled according to the practitioner's needs provided that sufficient quantity of the alkylbenzene mixture remains after distillation for evaluation by NMR methods NMR1 and NMR2.

Acidification (AC)

Salts of alkylbenzene sulfonic acids are acidified by common means such as reaction in a solvent with HCl or sulfuric acid or by use of an acidic resin such as Amberlyst 15. Acidification is routine to one skilled in the art. After acidifying remove all solvents, especially any moisture, so that the samples are anhydrous and solvent-free.

Note: For all of the below NMR test methods, the chemical shifts of the NMR spectrum are either externally or internally referenced to TMS in $CDCl_3$, i.e. chloroform.

NMR 1

$^{13}$C-NMR 2/3-Phenyl Index for Alkylbenzene Mixtures

A 400 mg sample of an alkylbenzene mixture is dissolved in 1 ml of anhydrous deuterated chloroform containing 1% v/v TMS as reference and placed in a standard NMR tube. The $^{13}$C NMR is run on the sample on a 300 MHz NMR spectrometer using a 20 second recycle time, a 40° $^{13}$C. pulse width and gated heteronuclear decoupling. At least 2000 scans are recorded. The region of the $^{13}$C NMR spectrum between about 145.00 ppm to about 150.00 ppm is integrated. The 2/3-Phenyl index of an alkylbenzene mixture is defined by the following equation:

2/3-Phenyl Index=(Integral from about 147.65 ppm to about 148.05 ppm)/(Integral from about 145.70 ppm to about 146.15 ppm)×100

NMR 2

$^{13}$C-NMR 2-Methyl-2-Phenyl Index

A 400 mg sample of an anhydrous alkylbenzene mixture is dissolved in 1 ml of anhydrous deuterated chloroform containing 1% v/v TMS as reference and placed in a standard NMR tube. The 13C NMR is run on the sample on a 300 MHz NMR spectrometer using a 20 second recycle time, a 40° $^{13}$C. pulse width and gated heteronuclear decoupling. At least 2000 scans are recorded. The $^{13}$C NMR spectrum region between about 145.00 ppm to about 150.00 ppm is integrated. The 2-methyl-2-phenyl index of an alkylbenzene mixture is defined by the following equation:

2-methyl-2-phenyl index=(Integral from about 149.35 ppm to about 149.80 ppm)/(Integral from about 145.00 ppm to about 150.00 ppm).

NMR 3

$^{13}$C-NMR 2/3-Phenyl Index for Alkylbenzene Sulfonic Acid Mixtures

A 400 mg sample of an anhydrous alkylbenzene sulfonic acid mixture is dissolved in 1 ml of anhydrous deuterated chloroform containing 1% v/v TMS as reference and placed in a standard NMR tube. The $^{13}$C NMR is run on the sample on a 300 MHz NMR spectrometer using a 20 second recycle time, a 40° $^{13}$C. pulse width and gated heteronuclear decoupling. At least 2000 scans are recorded. The $^{13}$C NMR spectrum region between about 152.50 ppm to about 156.90 ppm is integrated. The 2/3-Phenyl Index of an alkylbenzene sulfonic acid mixtures defined by the following equation:

2/3-Phenyl Index=(Integral from about 154.40 to about 154.80 ppm)/(Integral from about 152.70 ppm to about 153.15 ppm)×100

NMR 4

$^{13}$C-NMR 2-Methyl-2-Phenyl Index for Alkylbenzene Sulfonic Acid Mixtures

A 400 mg sample of an anhydrous alkylbenzene sulfonic acid mixture is dissolved in 1 ml of anhydrous deuterated chloroform containing 1% v/v TMS as reference and placed in a standard NMR tube. The $^{13}$C NMR is run on the sample on a 300 MHz NMR spectrometer using a 20 second recycle time, a 40° $^{13}$C. pulse width and gated heteronuclear decoupling. At least 2000 scans are recorded. The $^{13}$C NMR spectrum region between about 152.50 ppm to about 156.90 ppm is integrated. The 2-methyl-2-phenyl Index for an alkylbenzene sulfonic acid mixture is defined by the following equation:

2-methyl-2-phenyl index=(Integral from about 156.40 ppm to about 156.65 ppm)/(Integral from about 152.50 ppm to about 156.90 ppm).

Detergent Compositions in Detail

The enhanced alkylbenzene sulfonate surfactant mixtures of the present invention can be incorporated into cleaning compositions, typically termed "detergent compositions" herein since the preferred of such compositions are for laundry cleaning, especially in domestic washing machines or for hand-washing use. These compositions can be in any conventional form, namely, in the form of a liquid, powder, agglomerate, paste, tablet, bar, gel, or granule.

The detergent compositions of the present invention can more generally be used in a wide range of consumer cleaning product compositions including powders, liquids, granules, gels, pastes, tablets, pouches, bars, types delivered in dual-compartment containers, spray or foam detergents and other homogeneous or multiphase consumer cleaning product forms. They can be used or applied by hand and/or can be applied in unitary or freely alterable dosage, or by automatic dispensing means, or are useful in appliances such as washing-machines or dishwashers or can be used in institutional cleaning contexts, including for example, for personal cleansing in public facilities, for bottle washing, for surgical instrument cleaning or for cleaning electronic components. They can be used in aqueous or non-aqueous cleaning systems. They can have a wide range of pH, for example from about 2 to about 12 or higher, though alkaline detergent compositions having a pH of from about 8 to about 11 are among the preferred embodiments, and they can have a wide range of alkalinity reserve which can include very high alkalinity reserves as in uses such as drain unblocking in which tens of grams of NaOH equivalent can be present per 100 grams of formulation, ranging through the 1–10 grams of NaOH equivalent and the mild or low-alkalinity ranges of liquid hand cleaners, down to the acid side such as in acidic hard-surface cleaners. Both high-foaming and low-foaming detergent types are encompassed, as well as types for use in all known aqueous and non-aqueous consumer product-cleaning processes.

Laundry or Cleaning Adjunct Materials and Methods

In general, a laundry or cleaning adjunct is any material required to transform a composition containing only the minimum essential ingredients (herein the enhanced alkylbenzene sulfonate surfactant mixture) into a composition useful for laundry or other consumer product cleaning purposes. In preferred embodiments, laundry or cleaning adjuncts are easily recognizable to those of skill in the art as being absolutely characteristic of laundry or cleaning products, especially of laundry or cleaning products intended for direct use by a consumer in a domestic environment.

The precise nature of these additional components, and levels of incorporation thereof, will depend on the physical form of the composition and the nature of the cleaning operation for which it is to be used.

Preferably, the adjunct ingredients if used with bleach should have good stability therewith. Certain preferred detergent compositions herein should be boron-free and/or phosphate-free as required by legislation. Levels of adjuncts are from about 0.00001% to about 99.9%, by weight of the compositions. Use levels of the overall compositions can vary widely depending on the intended application, ranging for example from a few ppm in solution to so-called "direct application" of the neat cleaning composition to the surface to be cleaned.

Common adjuncts include builders, surfactants, enzymes, polymers, bleaches, bleach activators, catalytic materials and the like excluding any materials already defined hereinabove as part of the essential component of the inventive compositions. Other adjuncts herein can include suds boosters, suds suppressors (antifoams) and the like, diverse active ingredients or specialized materials such as dispersant polymers (e.g., from BASF Corp. or Rohm & Haas), color speckles, silvercare, anti-tarnish and/or anti-corrosion agents, dyes, fillers, germicides, alkalinity sources, hydrotropes, anti-oxidants, enzyme stabilizing agents, pro-perfumes, perfumes, solubilizing agents, carriers, processing aids, pigments, and, for liquid formulations, solvents.

Quite typically, laundry or cleaning compositions herein such as laundry detergents, laundry detergent additives, hard surface cleaners, synthetic and soap-based laundry bars, fabric softeners and fabric treatment liquids, solids and treatment articles of all kinds will require several adjuncts, though certain simply formulated products, such as bleach additives, may require only, for example, an oxygen bleaching agent and a surfactant as described herein. A comprehensive list of suitable laundry or cleaning adjunct materials and methods can be found in U.S. Provisional Patent application No. 60/053,318 filed Jul. 21, 1997 and assigned to Procter & Gamble.

Detergent Composition Examples

In these Examples, the following abbreviation is used for an enhanced alkylbenzene sulfonate surfactant mixture, acid form, sodium salt form or potassium salt form, prepared according to any of the preceding process examples: MLAS.

The following abbreviations are used for cleaning product adjunct materials:

| | |
|---|---|
| Cxy Amine Oxide | Alkyldimethylamine N-Oxide RN(O)Me2 of given chain length Cxy where average total carbon range of the non-methyl alkyl moiety R is from 10 + x to 10 + y |
| Amylase | Amylolytic enzyme of activity 60 KNU/g sold by NOVO Industries A/S under the tradename Termamyl 60T. Alternatively, the amylase is selected from: Fungamyl ®; Duramyl ®; BAN ®; and α-amylase enzymes described in WO95/26397 and in co-pending application by Novo Nordisk PCT/DK96/00056. |
| APA | C8-C10 amido propyl dimethyl amine |
| Cxy Betaine | Alkyldimethyl Betaine having an average total carbon range of alkyl moiety from 10 + x to 10 + y |
| Bicarbonate | Anhydrous sodium bicarbonate with a particle size distribution between 400 μm and 1200 μm |
| Borax | Na tetraborate decahydrate |
| BPP | Butoxy - propoxy - propanol |
| Brightener 1 | Disodium 4,4'-bis(2-sulphostyryl)biphenyl |
| Brightener 2 | Disodium 4,4'-bis(4-anilino-6-morpholino-1.3.5-triazin-2-yl)amino) stilbene-2:2'-disulfonate |
| $CaCl_2$ | Calcium chloride |
| Carbonate | $Na_2CO_3$ anhydrous, 200 μm - 900 μm |
| Cellulase | Cellulolytic enzyme, 1000 CEVU/g, NOVO, Carezyme ® |
| Citrate | Trisodium citrate dihydrate, 86.4%, 425 μm - 850 μm |
| Citric Acid | Citric Acid, Anhydrous |
| CMC | Sodium carboxymethyl cellulose |
| CxyAS | Alkyl sulfate, Na salt or other salt if specified having an average total carbon range of alkyl moiety from 10 + x to 10 + y |
| CxyEz | Commercial linear or branched alcohol ethoxylate (not having mid-chain methyl branching) and having an average total carbon range of alkyl moiety from 10 + x to 10 + y average z moles of ethylene oxide |

-continued

| | |
|---|---|
| CxyEzS | Alkyl ethoxylate sulfate, Na salt (or other salt if specified) having an average total carbon range of alkyl moiety from 10 + x to 10 + y and an average of z moles of ethylene oxide |
| Diamine | Alkyl diamine, e.g., 1,3 propanediamine, Dytek EP, Dytek A, (Dupont) or selected from: dimethyl aminopropyl amine; 1,6-hexane diamine; 1,3 propane diamine; 2-methyl 1,5 pentane diamine; 1,3-pentanediamine; 1-methyl-diaminopropane; 1,3 cyclohexane diamine; 1,2 cyclohexane diamine |
| Dimethicone | 40(gum)/60(fluid) wt. Blend of SE-76 dimethicone gum (G.E Silicones Div.) / dimethicone fluid of viscosity 350 cS. |
| DTPA | Diethylene triamine pentaacetic acid |
| DTPMP | Diethylene triamine penta (methylene phosphonate), Monsanto (Dequest 2060) |
| Endolase | Endoglucanase, activity 3000 CEVU/g, NOVO |
| EtOH | Ethanol |
| Fatty Acid (C12/18) | C12-C18 fatty acid |
| Fatty Acid (C12/14) | C12-C14 fatty acid |
| Fatty Acid (C14/18) | C14-C18 fatty acid |
| Fatty Acid (RPS) | Rapeseed fatty acid |
| Fatty Acid (TPK) | Topped palm kernel fatty acid |
| Formate | Formate (Sodium) |
| HEDP | 1,1-hydroxyethane diphosphonic acid |
| Hydrotrope | selected from sodium, potassium, Magnesium, Calcium, ammonium or water-soluble substituted ammonium salts of toluene sulfonic acid, naphthalene sulfonic acid, cumene sulfonic acid, xylene sulfonic acid. |
| Isofol 12 | X12 (average) Guerbet alcohols (Condea) |
| Isofol 16 | C16 (average) Guerbet alcohols (Condea) |
| LAS | Linear Alkylbenzene Sulfonate (e.g., C11.8, Na or K salt) |
| Lipase | Lipolytic enzyme, 100 kLU/g, NOVO, Lipolase ®. Alternatively, the lipase is selected from: Amano-P; M1 Lipase ®; Lipomax ®; D96L - lipolytic enzyme variant of the native lipase derived from Humicola lanuginosa as described in U.S. Ser. No. 08/341,826; and the Humicola lanuginosa strain DSM 4106. |
| LMFAA | C12-14 alkyl N-methyl glucamide |
| MA/AA | Copolymer 1:4 maleic/acrylic acid, Na salt, avg. mw. 70,000. |
| MBAxEy | Mid-chain branched primary alkyl ethoxylate (average total carbons = x; average EO = y) |
| MBAxEyS | Mid-chain branched or modified primary alkyl ethoxylate sulfate, Na salt (average total carbons = x; average EO = y) according to the invention (see Example 9) |
| MBAyS | Mid-chain branched primary alkyl sulfate, Na salt (average total carbons = y) |
| MEA | Monoethanolamine |
| Cxy MES | Alkyl methyl ester sulfonate, Na salt having an average total carbon range of alkyl moiety from 10 + x to 10 + y |
| $MgCl_2$ | Magnesium chloride |
| MnCAT | Macrocyclic Manganese Bleach Catalyst as in EP 544,440 A or, preferably, use [Mn(Bcyclam)$Cl_2$] wherein Bcyclam = 5,12-dimethyl-1,5,8,12-tetraaza-bicyclo[6.6.2]hexadecane or a comparable bridged tetra-aza macrocycle |
| NaDCC | Sodium dichloroisocyanurate |
| NaOH | Sodium hydroxide |
| Cxy NaPS | Paraffin sulfonate, Na salt having an average total carbon range of alkyl moiety from 10 + x to 10 + y |
| NaSKS-6 | Crystalline layered silicate of formula δ-$Na_2Si_2O_5$ |
| NaTS | Sodium toluene sulfonate |
| NOBS | Nonanoyloxybenzene sulfonate, sodium salt |
| LOBS | C12 oxybenzenesulfonate, sodium salt |
| PAA | Polyacrylic Acid (mw = 4500) |
| PAE | Ethoxylated tetraethylene pentamine |
| PAEC | Methyl quaternized ethoxylated dihexylene triamine |
| PB 1 | Anhydrous sodium perborate bleach of nominal formula $NaBO_2.H_2O_2$ |
| PEG | Polyethylene glycol (mw = 4600) |
| Percarbonate | Sodium Percarbonate of nominal formula $2Na_2CO_3.3H_2O_2$ |
| PG | Propanediol |
| Photobleach | Sulfonated Zinc Phthalocyanine encapsulated in dextrin soluble polymer |
| PIE | Ethoxylated polyethyleneimine, water-soluble |
| Protease | Proteolytic enzyme, 4 KNPU/g, NOVO, Savinase ® ®. Alternatively, the protease is selected from: Maxatase ®; Maxacal ®; Maxapem 15 ®; subtilisin BPN and BPN'; Protease B; Protease A; Protease D; Primase ®; Durazym ®; Opticlean ®;and Optimase ®; and Alcalase ®. |

-continued

| | |
|---|---|
| QAS | $R_2.N^+(CH_3)_x$ $((C_2H_4O)yH)z$ with $R_2 = C_8 - C_{18}$ $x + z = 3$, $x = 0$ to 3, $z = 0$ to 3, $y = 1$ to 15. |
| Cxy SAS | Secondary alkyl sulfate, Na salt having an average total carbon range of alkyl moiety from 10 + x to 10 + y |
| Silicate | Sodium Silicate, amorphous ($SiO_2$:$Na_2O$; 2.0 ratio) |
| Silicone antifoam | Polydimethylsiloxane foam controller + siloxane-oxyalkylene copolymer as dispersing agent; ratio of foam controller:dispersing agent = 10:1 to 100:1; or, combination of fumed silica and high viscosity polydimethylsiloxane (optionally chemically modified) |
| Solvent | nonaqueous solvent e.g., hexylene glycol, see also propylene glycol |
| SRP 1 | Sulfobenzoyl end capped esters with oxyethylene oxy and terephthaloyl backbone |
| SRP 2 | Sulfonated ethoxylated terephthalate polymer |
| SRP 3 | Methyl capped ethoxylated terephthalate polymer |
| STPP | Sodium tripolyphosphate, anhydrous |
| Sulfate | Sodium sulfate, anhydrous |
| TAED | Tetraacetylethylenediamine |
| TFA | C16-18 alkyl N-methyl glucamide |
| Zeolite A | Hydrated Sodium Aluminosilicate, $Na_{12}(AlO_2SiO_2)_{12}$. $27H_2O$; 0.1 - 10 $\mu$m |
| Zeolite MAP | Zeolite (Maximum aluminum P) detergent grade (Crosfield) |

Typical ingredients often referred to as "minors" can include perfumes, dyes, pH trims etc.

The following example is illustrative of the present invention, but is not meant to limit or otherwise define its scope. All parts, percentages and ratios used are expressed as percent weight unless otherwise noted.

Example 1

The following laundry detergent compositions A to F are prepared in accordance with the invention:

| | A | B | C | D | E | F |
|---|---|---|---|---|---|---|
| MLAS | 22 | 16.5 | 11 | 1–5.5 | 10–25 | 5–35 |
| Any Combination of: C45AS C45E1S or C23E3S LAS C26 SAS C47 NaPS C48 MES MBA16.5S MBA15.5E2S | 0 | 1–5.5 | 11 | 16.5 | 0–5 | 0–10 |
| QAS | 0–2 | 0–2 | 0–2 | 0–2 | 0–4 | 0 |
| C23E6.5 or C45E7 | 1.5 | 1.5 | 1.5 | 1.5 | 0–4 | 0–4 |
| Zeolite A | 27.8 | 0 | 27.8 | 27.8 | 20–30 | 0 |
| Zeolite MAP | 0 | 27.8 | 0 | 0 | 0 | 0 |
| STPP | 0 | 0 | 0 | 0 | 0 | 5–65 |
| PAA | 2.3 | 2.3 | 2.3 | 2.3 | 0–5 | 0–5 |
| Carbonate | 27.3 | 27.3 | 27.3 | 27.3 | 20–30 | 0–30 |
| Silicate | 0.6 | 0.6 | 0.6 | 0.6 | 0–2 | 0–6 |
| PB1 | 1.0 | 1.0 | 0–10 | 0–10 | 0–10 | 0–20 |
| NOBS | 0–1 | 0–1 | 0–1 | 0.1 | 0.5–3 | 0–5 |
| LOBS | 0 | 0 | 0–3 | 0 | 0 | 0 |
| TAED | 0 | 0 | 0 | 2 | 0 | 0–5 |
| MnCAT | 0 | 0 | 0 | 0 | 2 ppm | 0–1 |
| Protease | 0–0.5 | 0–0.5 | 0–0.5 | 0–0.5 | 0–0.5 | 0–1 |
| Cellulase | 0–0.3 | 0–0.3 | 0–0.3 | 0–0.3 | 0–0.5 | 0–1 |
| Amylase | 0–0.5 | 0–0.5 | 0–0.5 | 0–0.5 | 0–1 | 0–1 |
| SRP 1 or SRP 2 | 0.4 | 0.4 | 0.4 | 0.4 | 0–1 | 0–5 |
| Brightener 1 or 2 | 0.2 | 0.2 | 0.2 | 0.2 | 0–0.3 | 0–5 |
| PEG | 1.6 | 1.6 | 1.6 | 1.6 | 0–2 | 0–3 |
| Silicone Antifoam | 0.42 | 0.42 | 0.42 | 0.42 | 0–0.5 | 0–1 |
| Sulfate, Water, | to | to | to | to | to | to |

-continued

| | A | B | C | D | E | F |
|---|---|---|---|---|---|---|
| Minors | 100% | 100% | 100% | 100% | 100% | 100% |
| Density (g/L) | 400–700 | 600–700 | 600–700 | 600–700 | 600–700 | 450–750 |

Example 2

The following laundry detergent compositions G to J suitable for hand-washing soiled fabrics are prepared in accord with the invention:

| | G | H | I | J |
|---|---|---|---|---|
| MLAS | 18 | 22 | 18 | 22 |
| STPP | 20 | 40 | 22 | 28 |
| Carbonate | 15 | 8 | 20 | 15 |
| Silicates | 15 | 10 | 15 | 10 |
| Protease | 0 | 0 | 0.3 | 0.3 |
| Perborate | 0 | 0 | 0 | 10 |
| Sodium Chloride | 25 | 15 | 20 | 10 |
| Brightener | 0–0.3 | 0.2 | 0.2 | 0.2 |
| Moisture & Minors | | —Balance— | | |

Example 3

Cleaning Product Compositions

The following liquid laundry detergent compositions K to O are prepared in accord with the invention. Abbreviations are as used in the preceding Examples.

| | K | L | M | N | O |
|---|---|---|---|---|---|
| MLAS | 1–7 | 7–12 | 12–17 | 17–22 | 1–35 |
| Any combination of: C25E1.8–2.5S MBA15.5E1.8S | 15–21 | 10–15 | 5–10 | 0–5 | 0–25 |

-continued

| | K | L | M | N | O |
|---|---|---|---|---|---|
| MBA15.5S | | | | | |
| C25AS (linear to high 2-alkyl) | | | | | |
| C47 NaPS | | | | | |
| C26 SAS | | | | | |
| LAS | | | | | |
| C26 MES | | | | | |
| LMFAA | 0–3.5 | 0–3.5 | 0–3.5 | 0–3.5 | 0–8 |
| C23E9 or C23E6.5 | 0–2 | 0–2 | 0–2 | 0–2 | 0–8 |
| APA | 0–0.5 | 0–0.5 | 0–0.5 | 0–0.5 | 0–2 |
| Citric Acid | 5 | 5 | 5 | 5 | 0–8 |
| Fatty Acid (TPK or C12/14) | 2 | 2 | 2 | 2 | 0–14 |
| EtOH | 4 | 4 | 4 | 4 | 0–8 |
| PG | 6 | 6 | 6 | 6 | 0–10 |
| MEA | 1 | 1 | 1 | 1 | 0–3 |
| NaOH | 3 | 3 | 3 | 3 | 0–7 |
| Hydrotrope or NaTS | 2.3 | 2.3 | 2.3 | 2.3 | 0–4 |
| Formate | 0.1 | 0.1 | 0.1 | 0.1 | 0–1 |
| Borax | 2.5 | 2.5 | 2.5 | 2.5 | 0–5 |
| Protease | 0.9 | 0.9 | 0.9 | 0.9 | 0–1.3 |
| Lipase | 0.06 | 0.06 | 0.06 | 0.06 | 0–0.3 |
| Amylase | 0.15 | 0.15 | 0.15 | 0.15 | 0–0.4 |
| Cellulase | 0.05 | 0.05 | 0.05 | 0.05 | 0–0.2 |
| PAE | 0–0.6 | 0–0.6 | 0–0.6 | 0–0.6 | 0–2.5 |
| PIE | 1.2 | 1.2 | 1.2 | 1.2 | 0–2.5 |
| PAEC | 0–0.4 | 0–0.4 | 0–0.4 | 0–0.4 | 0–2 |
| SRP 2 | 0.2 | 0.2 | 0.2 | 0.2 | 0–0.5 |
| Brightener 1 or 2 | 0.15 | 0.15 | 0.15 | 0.15 | 0–0.5 |
| Silicone antifoam | 0.12 | 0.12 | 0.12 | 0.12 | 0–0.3 |
| Fumed Silica | 0.0015 | 0.0015 | 0.0015 | 0.0015 | 0–0.003 |
| Perfume | 0.3 | 0.3 | 0.3 | 0.3 | 0–0.6 |
| Dye | 0.0013 | 0.0013 | 0.0013 | 0.0013 | 0–0.003 |
| Moisture/minors | Balance | Balance | Balance | Balance | Balance |
| Product pH (10% in DI water) | 7.7 | 7.7 | 7.7 | 7.7 | 6–9.5 |

Example 4

Non-limiting examples P–Q of a bleach-containing non-aqueous liquid laundry detergent composition are prepared as follows:

| Component | P Wt. % | Q Range (% wt.) |
|---|---|---|
| Liquid Phase | | |
| MLAS | 15 | 1–35 |
| LAS | 12 | 0–35 |
| C24E5 | 14 | 10–20 |
| Solvent or Hexylene glycol | 27 | 20–30 |
| Perfume | 0.4 | 0–1 |
| Solid Phase | | |
| Protease | 0.4 | 0–1 |
| Citrate | 4 | 3–6 |
| PB1 | 3.5 | 2–7 |
| NOBS | 8 | 2–12 |
| Carbonate | 14 | 5–20 |
| DTPA | 1 | 0–1.5 |
| Brightener 1 | 0.4 | 0–0.6 |
| Silicon antifoam | 0.1 | 0–0.3 |
| Minors | Balance | Balance |

The resulting anhydrous heavy-duty liquid laundry detergent provides excellent stain and soil removal performance when used in normal fabric laundering operations.

Example 5

The following examples R–V further illustrate the invention herein with respect to shampoo formulations:

| Component | R | S | T | U | V |
|---|---|---|---|---|---|
| Ammonium C24E2S | 5 | 3 | 2 | 10 | 8 |
| Ammonium C24AS | 5 | 5 | 4 | 5 | 8 |
| MLAS | 0.6 | 1 | 4 | 5 | 7 |
| Cocamide MEA | 0 | 0.68 | 0.68 | 0.8 | 0 |
| PEG 14,000 mol. wt. | 0.1 | 0.35 | 0.5 | 0.1 | 0 |
| Cocoamidopropyl-betaine | 2.5 | 2.5 | 0 | 0 | 1.5 |
| Cetyl alcohol | 0.42 | 0.42 | 0.42 | 0.5 | 0.5 |
| Stearyl alcohol | 0.18 | 0.18 | 0.18 | 0.2 | 0.18 |
| Ethylene glycol distearate | 1.5 | 1.5 | 1.5 | 1.5 | 1.5 |
| Dimethicone | 1.75 | 1.75 | 1.75 | 1.75 | 2.0 |
| Perfume | 0.45 | 0.45 | 0.45 | 0.45 | 0.45 |
| Water and minors | balance | balance | balance | balance | balance |

What is claimed is:

1. An enhanced alkylbenzene sulfonate surfactant mixture comprising:

(a) from about 60% to about 25% by weight of a mixture of enhanced alkylbenzene sulfonates having formula (I):

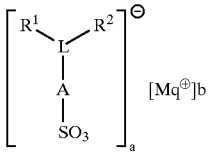

(I)

wherein L is an acyclic aliphatic moiety consisting of carbon and hydrogen, said L having two methyl termini and said L having no substituents other than A, $R^1$ and $R^2$; and wherein said mixture of enhanced alkylbenzene sulfonates contains two or more of said enhanced alkylbenzene sulfonates differing in molecular weight of the anion of said formula (I) and wherein said mixture of enhanced alkylbenzene sulfonates has a sum of carbon atoms in $R^1$, L and $R^2$ of from 9 to 15; an average aliphatic carbon content of from about 10.0 to about 14.0 carbon atoms; M is a cation or cation mixture having a valence q; a and b are integers selected such that said enhanced alkylbenzene sulfonates are electroneutral; $R^1$ is $C_1$–$C_3$ alkyl; $R^2$ is selected from H and $C_1$–$C_3$ alkyl; A is a benzene moiety; and (b) from about 40% to about 75% by weight of a mixture of modified unsubstituted alkylbenzene sulfonates having formula (II):

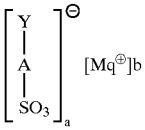

(II)

wherein a, b, M, A and q are as defined hereinbefore and Y is an unsubstituted linear aliphatic moiety consisting of carbon and hydrogen having two methyl termini, and wherein said Y has a sum of carbon atoms of from 9 to 15, preferably from 10 to 14, and said Y has an average aliphatic carbon content of from about 10.0 to about 14.0; and wherein said enhanced alkylbenzene sulfonate surfactant mixture is further characterized by a 2/3-phenyl index of from about 275 to about 10,000.

2. An enhanced alkylbenzene mixture comprising:

(a) from about 60% to about 25% by weight of a mixture of enhanced alkylbenzenes having formula (I):

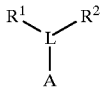

(I)

wherein L is an acyclic aliphatic moiety consisting of carbon and hydrogen, said L having two methyl termini and said L having no substituents other than A, R1 and R2; and wherein said mixture of enhanced alkylbenzenes contains two or more of said enhanced alkylbenzenes differing in molecular weight of said formula (I) and wherein said mixture of enhanced alkylbenzenes has a sum of carbon atoms in R1, L and R2 of from 9 to 15;

an average aliphatic carbon content of from about 10.0 to about 14.0 carbon atoms; R1 is C1–C3 alkyl; $R^2$ is selected from H and C1–C3 alkyl; A is a benzene moiety; and (b) from about 40% to about 75% by weight of a mixture of modified unsubstituted alkylbenzenes having formula (II):

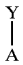

(II)

wherein A is as defined hereinbefore and Y is an unsubstituted linear aliphatic moiety consisting of carbon and hydrogen having two methyl termini, and wherein said Y has a sum of carbon atoms of from 9 to 15, preferably from 10 to 14, and said Y has an average aliphatic carbon content of from about 10.0 to about 14.0; and wherein said enhanced alkylbenzene mixture is further characterized by a 2/3-phenyl index of from about 275 to about 10,000.

3. An enhanced alkylbenzene sulfonate surfactant mixture according to claim 1 wherein M is selected from H, Na, K and mixtures thereof; a=1; b=1; q=1; and said enhanced alkylbenzene sulfonate surfactant mixture has a 2-methyl-2-phenyl index of less than about 0.3.

4. An enhanced alkylbenzene sulfonate surfactant mixture according to claim 3 which is the product of a process using as catalyst a zeolite selected from mordenite, offretite and H-ZSM-12 in at least partially acidic form.

5. An enhanced alkylbenzene sulfonate surfactant mixture according to claim 4 which is the product of a process using as a catalyst any catalyst that exhibits the same or similar characteristics as said mordenite, under the same or similar conditions of said process.

6. A detergent composition comprising:

a) from about 0.1% to about 95%, by weight of enhanced alkylbenzene sulfonate surfactant mixture according to claim 3;

b) from about 0.00001% to about 99.9%, by weight of conventional cleaning adjuncts other than surfactants; and c) from 0% to about 50%, by weight, of a surfactant other than said enhanced alkylbenzene sulfonate surfactant mixture;

provided that when said detergent composition comprises any other alkylbenzene sulfonate than the alkylbenzene sulfonate of said enhanced alkylbenzene sulfonate surfactant mixture, said enhanced alkylbenzene sulfonate surfactant mixture and said other alkylbenzene sulfonate, as a mixture, have an overall 2/3-phenyl index of from about 275 to about 10,000.

7. A medium 2/3-phenyl surfactant mixture consisting essentially of:

a) from 1% to about 60% by weight of a first alkylbenzene sulfonate surfactant, wherein said first alkylbenzene sulfonate surfactant is a enhanced alkylbenzene sulfonate surfactant mixture according to claim 1; and b) from 40% to about 99%, by weight of a second alkylbenzene sulfonate surfactant, wherein said second alkylbenzene sulfonate surfactant is an alkylbenzene sulfonate surfactant mixture other than said enhanced alkylbenzene sulfonate surfactant mixture according to claim 1, and wherein said second alkylbenzene sulfonate surfactant has a 2/3-phenyl index of from about 75 to about 160;

provided that said medium 2/3-phenyl surfactant mixture has a 2/3-phenyl index of from about 160 to about 275.

8. A detergent composition comprising:

(a) from about 0.1% to about 95% by weight of medium 2/3-phenyl surfactant mixture according to claim 7;

(b) from about 0.00001% to about 99.9% by weight of conventional cleaning adjuncts other than surfactants; and (c) from 0% to about 50% by weight of a surfactant other than said medium 2/3-phenyl surfactant mixture;

provided that when said detergent composition comprises any other alkylbenzene sulfonate than the alkylbenzene sulfonate of said medium 2/3-phenyl surfactant mixture, said medium 2/3-phenyl surfactant mixture and said other alkylbenzene sulfonate, as a mixture, have an overall 2/3-phenyl index of from about 160 to about 275.

9. A process for preparing a medium 2/3-phenyl surfactant mixture according to claim 8 comprising a step selected from:

(i) blending said first alkylbenzene sulfonate surfactant and said second alkylbenzene sulfonate surfactant; and (ii) blending the nonsulfonated precursor of said first alkylbenzene sulfonate surfactant and the nonsulfonated precursor of said second alkylbenzene sulfonate surfactant and sulfonating said blend.

10. A detergent composition comprising:

(a) from about 1% to about 50%, by weight of the product of claim 9; and (b) from about 0.00001% to about 99.9%, by weight of conventional cleaning adjuncts other than surfactants.

11. A detergent composition according to claim 6 or claim 8 wherein said conventional cleaning adjunct other than surfactants is selected from the group consisting of builders, detersive enzymes, bleaching systems, brighteners, at least partially water-soluble or water dispersible polymers, abrasives, bactericides, tarnish inhibitors, dyes, solvents, hydrotropes, perfumes, thickeners, antioxidants, processing aids, suds boosters, suds suppressors, buffers, anti-fungal agents, mildew control agents, insect repellents, anti-corrosive aids, chelants and mixtures thereof.

12. A detergent composition according to claim 6 or claim 8 wherein said cleaning composition is in the form of a liquid, powder, agglomerate, paste, tablet, bar, gel, or granule.

13. A method comprising treating a fabric with the detergent composition of claim 6 or claim 8.

14. An enhanced alkylbenzene sulfonate surfactant mixture comprising the product of a process comprising the steps of:

(I) alkylating benzene with an alkylating mixture;

(II) sulfonating the product of (I); and (III) neutralizing the product of (II);

wherein said alkylating mixture comprises:

(a) from about 1% to about 99.9%, by weight of methyl-substituted $C_9$–$C_{20}$ monoolefins, said methyl-substituted monoolefins having structures identical with those of the branched monoolefins formed by dehydrogenating branched paraffins of formula $R^1LR^2$ wherein L is an acyclic aliphatic moiety consisting of carbon and hydrogen and containing two terminal methyls; $R^1$ is $C_1$ to $C_3$ alkyl; and $R^2$ is selected from H and $C_1$ to $C_3$ alkyl; and (b) from about 0.1% to about 85%, by weight of $C_9$–$C_{20}$ linear aliphatic olefins;

wherein said alkylating mixture contains said branched $C_9$–$C_{20}$ monoolefins having at least two different carbon numbers in said $C_9$–$C_{20}$ range, and has a mean carbon content of from about 9.0 to about 15.0 carbon atoms; and wherein said components (a) and (b) are at a weight ratio of at least about 15:85.

15. An enhanced alkylbenzene sulfonate surfactant mixture according to claim 14 wherein said alkylating mixture consists essentially of:

(a) from about 0.5% to about 47.5%, by weight of said methyl-substituted alkylating agent selected from:

(i) $C_9$–$C_{14}$ internal monoolefins $R^1LR^2$ wherein L is an acyclic olefinic moiety consisting of carbon and hydrogen and containing two terminal methyls;

(ii) $C_9$–$C_{14}$ alpha monoolefins $R^1AR^2$ wherein A is an acyclic alpha-olefinic moiety consisting of carbon and hydrogen and containing one terminal methyl and one terminal olefinic methylene; and (iii) mixtures thereof;

wherein in any of (i)–(iii), $R^1$ is methyl, and $R^2$ is H or methyl provided that in at least about 0.7 mole fraction of the total of said monoolefins, $R^2$ is H; and (b) from about 0.1% to about 25%, by weight of $C_9$–$C_{14}$ linear aliphatic olefins; and (c) from about 10% to about 98.9%, by weight of carrier materials selected from paraffins and inert nonparaffinic solvents;

wherein said alkylating mixture contains said branched alkylating agents having at least two different carbon numbers in said $C_9$–$C_{14}$ range, and has a mean carbon content of from about 11.0 to about 12.0 carbon atoms; and wherein said components (a) and (b) are at a weight ratio of from about 60:40 to about 25:75.

16. An enhanced alkylbenzene sulfonate surfactant mixture according to claim 14 wherein said alkylating mixture comprising:

1) An olefin and/or olefin/paraffin mixture with chain length of which is obtained via dehydrogenation of a paraffin mixture obtained from kerosene feed stock via a molecular sieving unit designed to isolate a mixture, consisting mainly of both linear and monomethyl branched paraffins from cyclic and dimethyl branched paraffins Said mixture blended with linear olefin and or linear olefin/paraffin mixtures to achieve a linear content of 45% to 75% for said olefin and or olefin/paraffin mixtures.

17. An enhanced alkylbenzene sulfonate surfactant mixture according to claim 14 wherein said alkylating mixture consists essentially of:

an olefin and/or olefin/paraffin mixture with chain length, which is obtained via any one of the following:

an olefin mixture with chain length, which is obtained via any one of the following:

9) Dimerization of short chain olefin mixtures inside a molecular sieve

10) Oligomerization of short chain olefin mixtures inside a molecular sieve

11) Dehydrogenation of a paraffin mixture obtained from a gas to liquids (GTL) plant;

12) Product of cracking long-chain hydrocarbon waxes under conditions to obtain a mainly mono methyl branched olefin or olefin/paraffin mixture.

Said olefin or olefin/paraffin mixture is blended with linear olefins or linear olefin/paraffin mixture to provide a linear content of said mixture of about 40% to about 75%.

18. An enhanced alkylbenzene mixture according to claim 16 or 17 comprising the product of a process comprising the step of alkylating benzene with said alkylating mixture.

19. An enhanced alkylbenzene sulfonate surfactant mixture according to claim 14 wherein said step (III) is performed using a basic salt, said basic salt having a cation selected from the group consisting of alkali metal, alkaline earth metal, ammonium, substituted ammonium, and mixtures thereof and an anion selected from hydroxide, oxide, carbonate, silicate, phosphate, and mixtures thereof.

20. An enhanced alkylbenzene sulfonate surfactant mixture according to claim 14 wherein step (II) is performed using a sulfonating agent selected from the group consisting of sulfur trioxide, sulfur trioxide/air mixtures, and sulfuric acid.

21. A detergent composition comprising:

(a) from about 1% to about 50%, by weight of enhanced alkylbenzene sulfonate surfactant mixture according to claim 1, wherein said enhanced alkylbenzene sulfonate surfactant mixture has a 2-methyl-2-phenyl index of less than about 0.3;

(b) from about 0.000001% to about 10%, by weight of a member selected from the group consisting of optical brighteners, dyes, photobleaches, hydrophobic bleach activators and transition metal bleach catalysts;

(c) from 0.1% to about 40% by weight of surfactants selected from the group consisting of cationic surfactants, nonionic surfactants, anionic surfactants, and amine oxide surfactants; and (d) from about 10% to about 99%, by weight of conventional cleaning adjuncts;

provided that when said detergent composition comprises any alkylbenzene sulfonate surfactant other than said enhanced alkylbenzene sulfonate surfactant mixture, said detergent composition is further characterized by an overall 2/3-phenyl index of at least about 200, wherein said overall 2/3-phenyl index is determined by measuring 2/3-phenyl index, as defined herein, on a blend of said enhanced alkylbenzene sulfonate surfactant mixture and said any other alkylbenzene sulfonate to be added to said detergent composition, said blend, for purposes of measurement, being prepared from aliquots of said enhanced alkylbenzene sulfonate surfactant mixture and said other alkylbenzene sulfonate not yet exposed to any other of said components of the detergent composition; and further provided that when said detergent composition comprises any alkylbenzene sulfonate surfactant other than said enhanced alkylbenzene sulfonate surfactant mixture, said detergent composition is further characterized by an overall 2-methyl-2-phenyl index of less than about 0.3, wherein said overall 2-methyl-2-phenyl index is to be determined by measuring 2-methyl-2-phenyl index, as defined herein, on a blend of said enhanced alkylbenzene sulfonate surfactant mixture and any other alkylbenzene sulfonate to be added to said detergent composition, said blend, for purposes of measurement, being prepared from aliquots of said enhanced alkylbenzene sulfonate surfactant mixture and said other alkylbenzene sulfonate not yet exposed to any other of said components of the detergent composition.

22. A detergent composition according to claim 21 which comprises, in said component (c), a nonionic surfactant at a level of from about 0.5% to about 25% by weight of said detergent composition, and wherein said nonionic surfactant is a polyalkoxylated alcohol in capped or non-capped form having:

a hydrophobic group selected from linear $C_{10}$–$C_{16}$ alkyl, mid-chain $C_1$–$C_3$ branched $C_{10}$–$C_{16}$ alkyl, guerbet branched $C_{10}$–$C_{16}$ alkyl, and mixtures thereof and a hydrophilic group selected from 1–15 ethoxylates, 1–15 propoxylates 1–15 butoxylates and mixtures thereof, in capped or uncapped form.

23. A detergent composition according to claim 21 having a form selected from the group consisting of: heavy-duty liquid detergent, syndet laundry bar, and/or heavy-duty granule.

24. A process for making an enhanced alkylbenzene sulfonate surfactant mixture comprising the steps of:

(I) alkylating benzene with an alkylating mixture;

(II) sulfonating the product of (I); and (III) optionally, neutralizing the product of (II);

wherein said alkylating mixture comprises:

(a) from about 1% to about 99.9%, by weight of methyl-substituted $C_9$–$C_{20}$ monoolefins, said methyl-substituted monoolefins having structures identical with those of the branched monoolefins formed by dehydrogenating branched paraffins of formula $R^1LR^2$ wherein L is an acyclic aliphatic moiety consisting of carbon and hydrogen and containing two terminal methyls; $R^1$ is $C_1$ to $C_3$ alkyl; and $R^2$ is selected from H and $C_1$ to $C_3$ alkyl; and (b) from about 0.1% to about 85%, by weight of $C_9$–$C_{20}$ linear aliphatic olefins.

* * * * *